US007316186B1

(12) United States Patent
Robinson et al.

(10) Patent No.: US 7,316,186 B1
(45) Date of Patent: Jan. 8, 2008

(54) AIR-POWERED ELECTRO-MECHANICAL FUZE FOR SUBMUNITION GRENADES

(75) Inventors: Charles H. Robinson, Silver Spring, MD (US); Robert H. Wood, Laurel, MD (US); Mark R. Gelak, Columbia, MD (US); Thinh Q. Hoang, Richmond, VA (US)

(73) Assignee: The United States of America as represented by the Secretary of the Army, Washington, DC (US)

( * ) Notice: Subject to any disclaimer, the term of this patent is extended or adjusted under 35 U.S.C. 154(b) by 24 days.

(21) Appl. No.: 11/164,426

(22) Filed: Nov. 22, 2005

Related U.S. Application Data

(60) Provisional application No. 60/522,988, filed on Nov. 30, 2004.

(51) Int. Cl.
*F42C 15/24* (2006.01)

(52) U.S. Cl. ..... 102/251; 102/247; 102/252

(58) Field of Classification Search ..... 102/221, 102/222, 226, 227, 228, 229, 230, 247, 248, 102/251, 252, 208
See application file for complete search history.

(56) References Cited

U.S. PATENT DOCUMENTS

| | | | | |
|---|---|---|---|---|
| 6,167,809 | B1 * | 1/2001 | Robinson et al. | 102/235 |
| 6,314,887 | B1 * | 11/2001 | Robinson | 102/262 |
| 6,321,654 | B1 * | 11/2001 | Robinson | 102/251 |
| 6,431,071 | B1 * | 8/2002 | Hodge et al. | 102/254 |
| 6,568,329 | B1 * | 5/2003 | Robinson | 102/231 |
| 6,964,231 | B1 * | 11/2005 | Robinson et al. | 102/235 |
| 7,007,606 | B1 * | 3/2006 | Maurer et al. | 102/226 |
| 7,040,234 | B1 * | 5/2006 | Maurer et al. | 102/226 |
| 2003/0070571 | A1 * | 4/2003 | Hodge et al. | 102/221 |

* cited by examiner

*Primary Examiner*—James S. Bergin
*Assistant Examiner*—Benjamin P. Lee
(74) *Attorney, Agent, or Firm*—John F. Moran

(57) ABSTRACT

A fuze for a submunition comprises a fuze housing with a stabilizer ribbon for aerodynamic orientation, a fuze slider released by tension on the stabilizer ribbon, an air-powered electric generator extended into the airstream by the fuze slider and powered in flight by high-speed airflow, a MEMS safety and arming device, a fuze circuit board including an explosive fireset, and an electrically initiated firetrain. The fuze is fixed to and communicates explosively with the end of a grenade warhead.

26 Claims, 15 Drawing Sheets

AIR-POWERED ELECTRO-MECHANICAL FUZE FOR SUBMUNITION GRENADES

CROSS-REFERENCE TO RELATED APPLICATIONS

This application claims the benefit under 35 USC 119(e) of U.S. provisional patent application 60/522,988 filed on Nov. 30, 2004, which application is hereby incorporated by reference.

BACKGROUND OF THE INVENTION

The invention relates in general to submunitions and grenades and, more particularly, to an environmentally energized safety, arming, and detonation device for a submunition, which is more reliable and safer than conventional devices.

Known dual-purpose improved conventional munition (DPICM) grenade fuzes such as the M223 and M234 detonate the grenade warhead on impact with ground or target through use of an inertial stab bolt or firing pin and a stab detonator. The grenades are stacked in a mechanically safe (unarmed) state inside a rocket or "cargo" round. When grenades are stacked in the cargo round, the tip end of the threaded firing pin engages the arming slider and prevents the arming slider from moving into the armed position. Since the slider must be moved for the explosive to detonate, the grenade cannot be detonated, and, as stored, is safe.

When expelled from its carrier round (such as a missile or projectile), the grenade is moving at the carrier's forward velocity and may tumble in the airstream. The grenade is quickly oriented, stabilized and decelerated by a ribbon loop that is extended from the top of the grenade fuze. Depending upon the carrier, e.g., artillery or rocket, the grenade may have a relatively high or low spin rate, respectively. An end of the stabilizer ribbon is attached to a threaded firing pin inside the grenade.

As the grenade falls, the drag or spin of the ribbon produces a relative rotational force between the grenade and ribbon. That rotational force with drag tension turns the threaded firing pin out of a threaded collar and extracts the stab bolt tip from a retaining hole or socket in a slider, disengaging the tip of the firing pin from the arming slider. The arming slider contains a stab-initiated detonator that can be in an aligned or non-aligned state with reference to the stab bolt and the grenade warhead. Released from the hold of the pin, the slider is forced radially outward, by a combination of the centrifugal force of the rotating grenade and/or an arming spring to a radial position at which the stab detonator carried in the grenade becomes aligned with both the lead explosive charge and the line of action of the firing pin. At that point in the flight, the grenade has become fully armed, and the arming spring holds the slider in that fully armed position.

On grenade impact, the stab firing pin, which has been de-threaded from the threaded collar, is free to move under inertial (e.g., impact) forces such that it initiates the stab detonator, which initiates the explosive train through contact with the lead charge at a high velocity. As is typical of this type of DPICM fuze, however, the required striking action by the firing pin is not very reliable because its mechanical sensitivity depends on the angle of impact. Impact by the submunition must be very close to vertical with respect to the grenade axis and with sufficient force and abruptness for the firing pin to operate properly. Additionally, the ribbon that is deployed to unscrew the firing pin is unreliable. For slow spinning or nonspinning rounds, such as those carried by rockets, the ribbon does not generate enough spin on its own to reliably unscrew and release the firing pin.

Current DPICM fuzes generally have low primary reliability (function on target), as low as 96% or less, which means that the population of grenades deployed by the weapon automatically loses, in the aggregate, up to 4% of its effectiveness on first impact with the target. One of the primary causes of this unreliability is the poor off-axis sensitivity of the current stab-detonator mechanisms. One response to this reliability problem by grenade manufacturers is to use some type of self-destruct (SD) mechanism in the fuze.

An electromechanical version of a self-destruct mechanism includes a battery ampoule, an electronic timer, and a capacitor. When the slider is forced radially outward, a spiral locking mechanism releases a battery activator, which ruptures an ampoule of a reserve battery. During the movement of the battery activator, an electrical short-circuit is also removed so that as the battery charges, it activates the electronic timer. If the grenade fails to function upon impact and after a lapse of a predetermined time, the capacitor discharges into the electro-explosive device next to the detonator, which causes the munition to function. In a pyrotechnic delay version of a self destruct mechanism, the pyrotechnic delay mix initiates immediately when the slider moves into the armed position, and if the grenade fails to function upon impact after a lapse of a predetermined time, the pyrotechnic delay train initiates the detonator.

However, the addition of a time-delay self-destruct (SD) mechanism, whether pyrotechnic or electronic in function, introduces new hazards. For example, a DPICM-loaded Multiple Launch Rocket System (MLRS) rocket battery or an MLRS-bearing mobile platform may suffer damage leading to unintended grenade dispense. This damage can occur due to a rocket-propelled grenade (RPG) attack or the impact of an improvised explosive device (IED) or an incident in a munitions depot. Some of the released grenades can tumble or roll and release the arming slider, which (in known designs) automatically initiates the self-destruct mechanism. An even greater hazard results from accidental dispense of the described self-destruct type grenades due to damage to a mobile platform carrying MLRS type rockets, for example, on the deck or in the hold of a ship or in an air vehicle while it is being carried. Also, the SD mechanisms also are not highly reliable.

Duds on the battlefield in which both the impact destruct and SD functions have failed are highly dangerous because they remain mechanically armed after dudding and can be detonated at any time by handling or jostling that moves the inertial detonator pin. Additionally, the SD mechanisms add undesired complexity and cost to the current DPICM fuze. One part of that complexity is that electrically enabled SD mechanisms require batteries, which add considerable expense and have limited reliability.

The prior art fuze occupies a significant portion of the package of the grenade and relies solely upon a series of mechanical operations to arm and ready the grenade for detonation upon impact with a target. Should the impact function fail, the result is an armed unexploded grenade, a "hazardous dud". The inclusion of the self-destruct mechanism does little for primary reliability (function on target) but does detonate and therefore clean up a proportion of the hazardous duds. Due to the large quantity of grenades typically deployed in the various munition delivery vehicles (e.g., MLRS rockets), however, there may remain a significant quantity of hazardous duds that can be triggered upon contact by vehicle or personnel walking though the battlefield Additionally, in the known fuze, there is stored energy (a compressed spring) that tends to move the arming slider into the armed position once the grenades are de-nested. In an accident or warfare scenario wherein an unlaunched missile containing submunition grenades is ruptured or blasted apart, there will be some twisting and rolling of grenades relative to their stabilizer ribbons. This twisting or rolling may be sufficient to unscrew the stab pin or bolt from its captive state, which releases the arming slider. In an accident scenario numerous armed duds may be produced, resulting in a very hazardous situation.

SUMMARY OF THE INVENTION

It is an object of the invention to provide a DPICM fuze that improves fuze safety and reliability by deriving arming and firing energy from the carrier round launch environment and the submunition post-dispense flight environment.

It is another object of the invention to provide a fuze wherein the stab-bolt mechanism is replaced with a time-gated, MEMS (micro-electro-mechanical systems) g-switch (accelerometer).

A further object of the invention is to provide a submunition that, if dudded, is safer to handle than prior dudded submunitions because the fuze cannot retain or accidentally regenerate firing energy.

Still another object of the invention is to provide a submunition or grenade fuze that is more sensitive to oblique angles of impact with targets.

Yet another object of the invention is to reduce the cost and improve the safety of the submunition fuze by eliminating the need for a self-destruct mechanism.

A still further object of the invention is to provide a safety and arming mechanism that is sensitive to setback acceleration followed by deceleration due to free fall in the atmosphere.

One aspect of the invention is a MEMS safety and arming mechanism comprising a setback slider operable to move in a first direction from a safe position to a latched position in response to a setback acceleration, the setback slider being spring biased against movement in the first direction; an arming slider operable to move in a second direction opposite the first direction, from a safe position to an armed position in response to a deceleration, the arming slider being spring biased against movement in the second direction; a first lock that prevents movement of the arming slider, the first lock comprising a setback sequence pivot that is rotatable from a first position that prevents movement of the arming slider to a second position that allows movement of the arming slider, the second position of the setback sequence pivot being attained when the setback slider reaches the latched position and the arming slider begins movement in the second direction; and a second lock that prevents movement of the arming slider, the second lock comprising a command rotor that is rotatable from a first position that prevents movement of the arming slider to a second position that allows movement of the arming slider, the second position of the command rotor being attained in response to a command arm electrical signal that is generated externally of the MEMS safety and arming mechanism.

The MEMS safety and arming mechanism further comprises a substrate and a frame above the substrate, the frame including openings in which each of the setback slider, arming slider, first lock and second lock move. The arming slider includes a transfer charge disposed therein.

Another aspect of the invention is a MEMS safety and arming device that includes the MEMS safety and arming mechanism described above and further includes an input explosive column located adjacent one end of the transfer charge when the arming slider is in the armed position such that detonation of the input explosive column causes detonation of the transfer charge and located distant the one end of the transfer charge when the arming slider is in the safe position such that detonation of the input explosive column does not cause detonation of the transfer charge; and an output explosive column located adjacent another end of the transfer charge when the arming slider is in the armed position such that detonation of the transfer charge causes detonation of the output explosive column and located distant the another end of the transfer charge when the arming slider is in the safe position such that detonation of the transfer charge does not cause detonation of the output explosive column.

The MEMS safety and arming device further comprises a cover assembly with an explosive initiator, the cover assembly being disposed over the frame, the input explosive column being disposed in the cover assembly with one end of the input explosive column adjacent the explosive initiator such that detonation of the initiator causes detonation of the input explosive column.

In addition, the MEMS safety and arming device includes an explosive output assembly with an explosive output charge, the explosive output assembly being disposed below the frame, the output explosive column being disposed in the explosive output assembly with one end of the output explosive column adjacent the explosive output charge such that detonation of the output explosive column causes detonation of the explosive output charge.

Yet another aspect of the invention is a fuze for a munition having a warhead, the fuze comprising a fuze housing; a fuze slider having a first position in the fuze housing and a second position at least partially out of the fuze housing; and the MEMS safety and arming device described above, disposed in the fuze housing.

In one embodiment of the fuze, the safety and arming device is attached to the fuze slider and, in the first position of the fuze slider, the explosive output charge of the safety and arming device is located such that detonation of the explosive output charge does not cause detonation of the warhead and, in the second position of the fuze slider, the explosive output charge of the safety and arming device is located such that detonation of the explosive output charge does cause detonation of the warhead.

The fuze further comprises a fuze circuit board electrically connected to the safety and arming device; an accelerometer electrically connected to the fuze circuit board; and an air powered generator disposed on the fuze slider and electrically connected to the fuze circuit board. Preferably, a ribbon is attached to the fuze housing wherein drag force on the ribbon is operable to free the fuze slider to move at least partially out of the fuze housing. In the second position of the fuze slider, the air powered generator supplies electric power and a signal indicative of fuze deceleration to the fuze circuit board as the fuze decelerates in the atmosphere.

Still another aspect of the invention is a method of exploding a warhead attached to a fuze, comprising accelerating the fuze to move a setback slider from a safe position to a latched position, thereby freeing a first lock on an arming slider; decelerating the fuze; sending a command arm electrical signal to a second lock to free the second lock on the arming slider; moving the arming slider to an armed position, if a deceleration of the fuze is greater than a spring force on the arming slider; sensing an impact using an accelerometer; sending a fire signal to an explosive initiator; detonating a transfer charge disposed in the arming slider, if the arming slider is in the armed position; and detonating the warhead.

In the method, the fuze includes a fuze slider having a first position inside the fuze housing and a second position at least partially out of the fuze housing; the method further comprising detonating the warhead only if the fuze slider is in the second position.

In accordance with the method, the first lock comprises a setback sequence pivot and the second lock comprises a command rotor, the method further comprising beginning movement of the arming slider prior to sending the command arm electrical signal.

The invention will be better understood, and further objects, features, and advantages thereof will become more apparent from the following description of the preferred embodiments, taken in conjunction with the accompanying drawings.

BRIEF DESCRIPTION OF THE DRAWINGS

In the drawings, which are not necessarily to scale, like or corresponding parts are denoted by like or corresponding reference numerals.

DETAILED DESCRIPTION OF THE PREFERRED EMBODIMENTS

Figure 1:
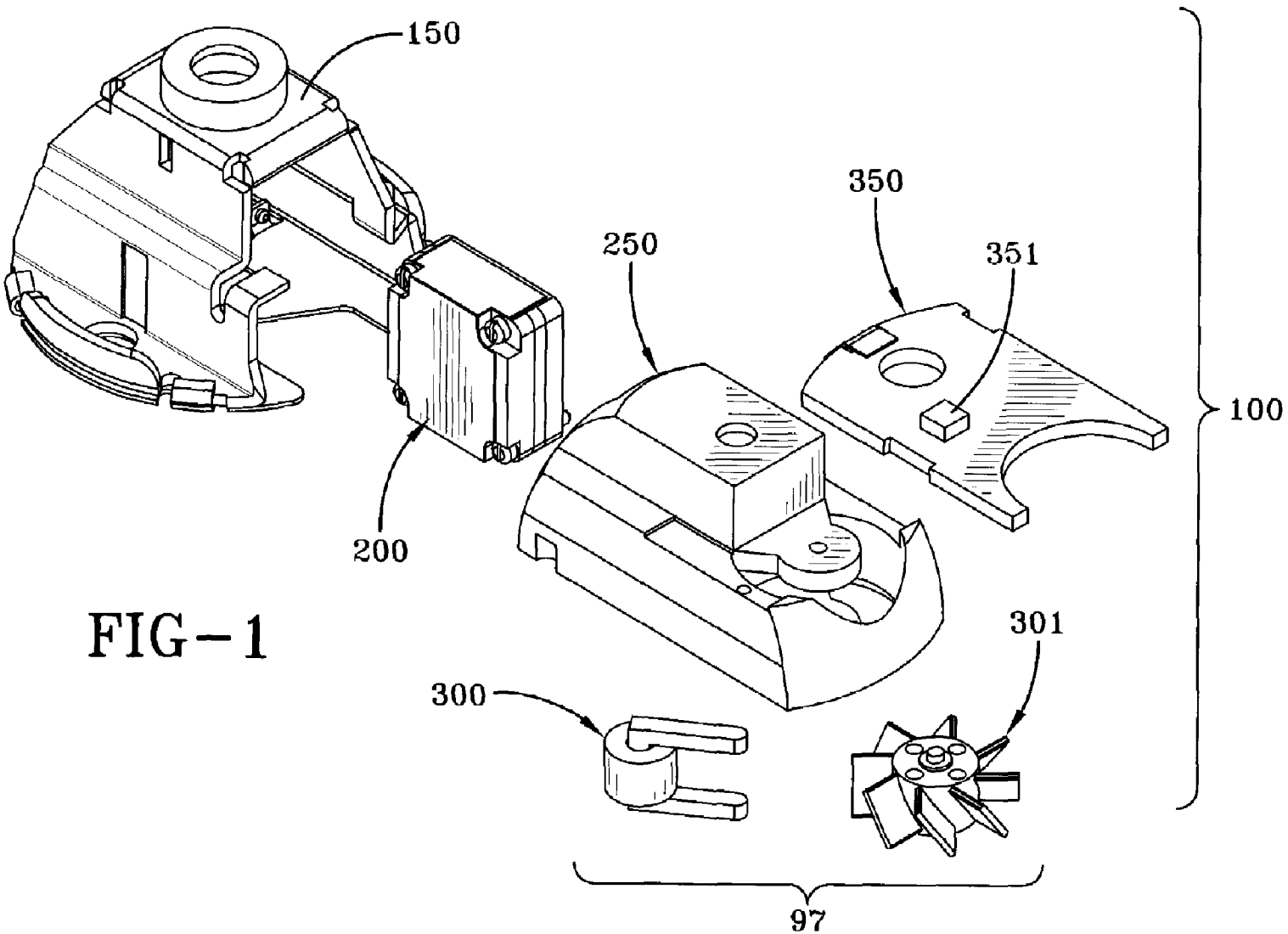
FIG. 1 is an exploded isometric view of a first embodiment of a fuze according to the invention.

The invention relates to a submunition (grenade), an electro-mechanical fuze for the submunition and a safety and arming (S&A) device for the fuze. The invention incorporates interrelated mechanical and electronic safety logic for reliability and safety. An important application of the invention is in fuzing for submunition grenades that are deployed by gun-launched "cargo" munitions or grenade-carrying rockets or missiles. The inventive fuze can, in general, perform as the fuze for all high-speed-dispensed submunition grenades launched aboard rockets (e.g., MLRS, Hydra 2.75", etc.) or gun-launched using cargo rounds (e.g., ERGM), and including submunitions such as EX-1, BLU-97/B, M74, M77, M85, all DPICM rounds, and involving fuzes such as XM234, M235, etc. The inventive fuze is particularly useful for grenades used in MLRS rockets on Marine HIMARS (high-mobility artillery rocket system) 6×6 truck platforms, especially those carried shipboard, because of its unusually high degree of safety in accident scenarios. The fuze will function equally well in all tube-launched "cargo" rounds (such as artillery or mortar) and rockets (such as the MLRS family of rockets and the 2.75-inch rocket) carrying DPICM grenades.

The improved safety of the inventive fuze reduces the risks to friendly forces posed by unintended/accidental dispense of submunition grenades in the theater of war where, for example, an MLRS rocket pod could be ruptured by an enemy attack with RPGs or improvised explosive devices and DPICM grenades could be dispensed. It also reduces the risk posed by accidental dispense due to accident scenarios aboard ships (as in Navy transport of weapon platforms carrying MLRS rockets loaded with DIPCM grenades).

The inventive fuze comprises a fuze housing with a stabilizer ribbon for aerodynamic orientation, a fuze slider released by tension on the stabilizer ribbon, an air-powered electric generator extended into the airstream by the fuze slider and powered in flight by high-speed airflow, a miniature mechanical safety and arming device, a fuze circuit board including an explosive fireset, and an electrically initiated firetrain. The fuze is fixed to and communicates explosively with the end of a grenade warhead.

The inventive fuze operates upon a more robust and unique combination of arming environments than have previously been used to arm submunition grenades, thus enhancing both reliability and safety. For example, stabilizer-ribbon twist is not a feature or requirement of arming. Therefore, stabilizer ribbon twist caused by unintended rolling of the grenade poses no danger. In contrast, in existing grenade fuzes, stabilizer ribbon twist is a required part of the sequence of mechanical arming and should have unique causes. However, twist of the stabilizer-ribbon can occur in unintended scenarios, for example, when an accidentally dispensed grenade is rolling on the deck of a ship or is tumbled by explosive blast at the launch platform.

Arming of the inventive fuze requires simultaneous, rather than merely sequential, operation of the required launch/deployment environments. For instance, the set-forward drag of free-fall must be imposed continually during a certain period for the command-arm function to work. The arming environments include rocket/cargo-munition setback during launch, post-dispense oriented airflow; and continuing post-dispense high-speed air flow. Pre-launch safety depends upon a lack of setback acceleration, a lack of de-nesting of grenades, a lack of high-speed airflow, and a lack of simultaneous aerodynamic drag. Post-launch safety depends upon, for example, the cessation of high-speed airflow, which is the only source of fuze circuit and firetrain initiation power, and the bleed-down of firing energy in the fuze circuit after ground impact.

Post-deployment safety is improved, in the case of duds left on the battlefield, by using only electric initiation and by removing the possibility of re-energization of the circuit after high-speed flight has once been detected. The inventive fuze reduces the necessity for UXO (unexploded ordnance) cleanup, by virtue of improved primary (on-target) reliability. It reduces the hazard, when duds do occur, of UXO cleanup because the fuze cannot be mechanically initiated. The invention reduces cost by eliminating the need for a self-destruct mechanism The inventive fuze is able to function in typical rocket or cargo-projectile dispense airspeed, e.g., on the range 300-m/s to 850-m/s maximum for MLRS rockets, 105-mm projectiles, etc. It is able to perform all arming functions fully within 8 seconds of dispense (minimum flight time), and function upon target impact within 30 or more seconds (maximum flight time) after dispense. Further, it is able to physically fit within the same physical envelope as conventional submunition grenade fuzes, to allow grenade stacking. The primary reliability of the invention is better than 99% reliable due to the improved sensitivity of target impact function. The fuze meets all safety requirements of current fuze safety standards, including MIL-STD-1316 and STANAG 4187.

The fuze firetrain is mechanically doubly out-of line when the grenade is nested with other grenades in the carrier round. First, a fuze slider holds the MEMS S&A firetrain out of line with the grenade warhead until the fuze slider is released by removal of the ribbon attachment pin. A spring moves the fuze slider into a position where the output explosive of the MEMS S&A firetrain is in-line with the grenade warhead explosive. Secondly, within the MEMS S&A device the input explosive column remains out of line with the output explosive column via the position of the MEMS S&A arming slider, until later in the operational cycle.

A first embodiment of a DPICM-type submunition grenade fuze 100 is shown in exploded view in FIG. 1. The fuze 100 comprises a fuze housing 150 and a fuze slider 250 that is operable to move at least partially out of the housing 150. A micro-electro-mechanical systems (MEMS)-based S&A device 200 fits inside the movable fuze slider 250. A miniature air-powered turbine generator (MAPG) 97 comprising a stator and coil set 300 and an air turbine and magnet set 301 is disposed on the fuze slider 250. A fuze circuit board 350 with an integrated micro-scale omni-directional g-switch 351 is attached to the slider 250 and travels with it.

Attaching the fuze circuit board 350 to the slider 250 simplifies the electrical connection of the circuit board 350 to the S&A device 200 and the MAPG 97. However, the fuze circuit board 350 may be part of the fixed housing 150, for example, with a flex circuit connecting it electrically to the S&A device 200 and/or the MAPG 97.

The MAPG 97 is small enough to function by being extended into the airstream by fuze slider 250 and it uses high-speed airflow to produce power to operate the fuze circuit board 350. The MAPG 97 is not able to produce significant power under low-velocity flow conditions, a characteristic that is important to the safety of fuze 100.

While the MAPG 97 in FIG. 1 is an axial-flow turbine with integrated magnets, etc., other configurations of miniature air-power generators are possible, for example a paddlewheel or whistle or vibrating reed generator. In fuze 100 the S&A device 200 and the MAPG 97 slide in unison as part of the fuze slider 250 to extend the MAPG 97 into the air stream. However, the same result could be had with a fuze that holds the S&A device 200 in-line with the warhead 99 firetrain while displacing only the MAPG 97 into the airstream using a slide, pivot or some other means of extension. The alignment or extension of the S&A device 200 or the MAPG 97, respectively, need not necessarily occur at the same time or as the result of the same motion (e.g., de-nesting of the grenade 400 and fuze slider 250 extension).

Figure 2:
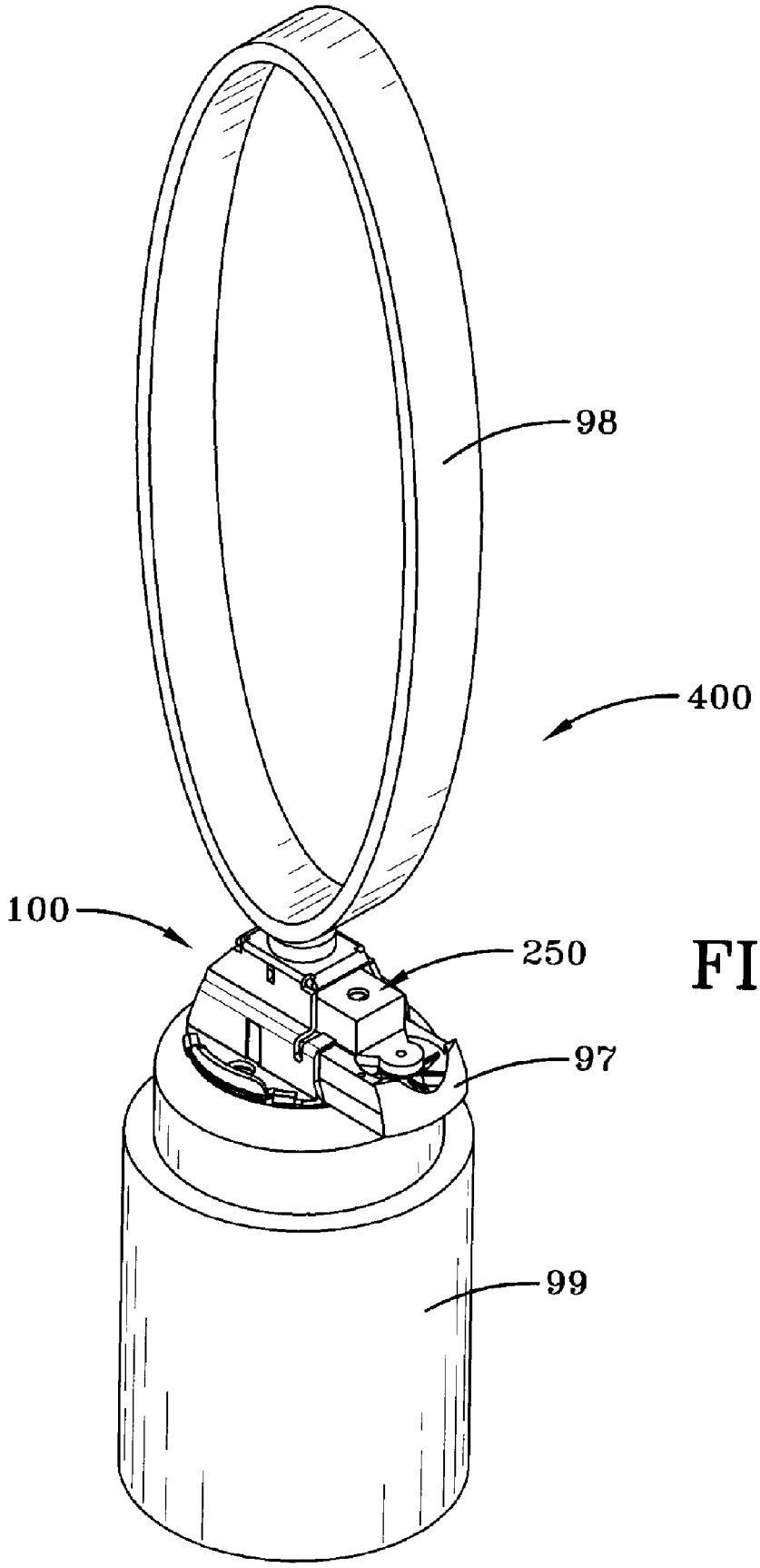
FIG. 2 is an isometric view of a fuze mated to a grenade warhead, with the fuze slider extended and a stabilizer ribbon unfurled.
Figure 3:
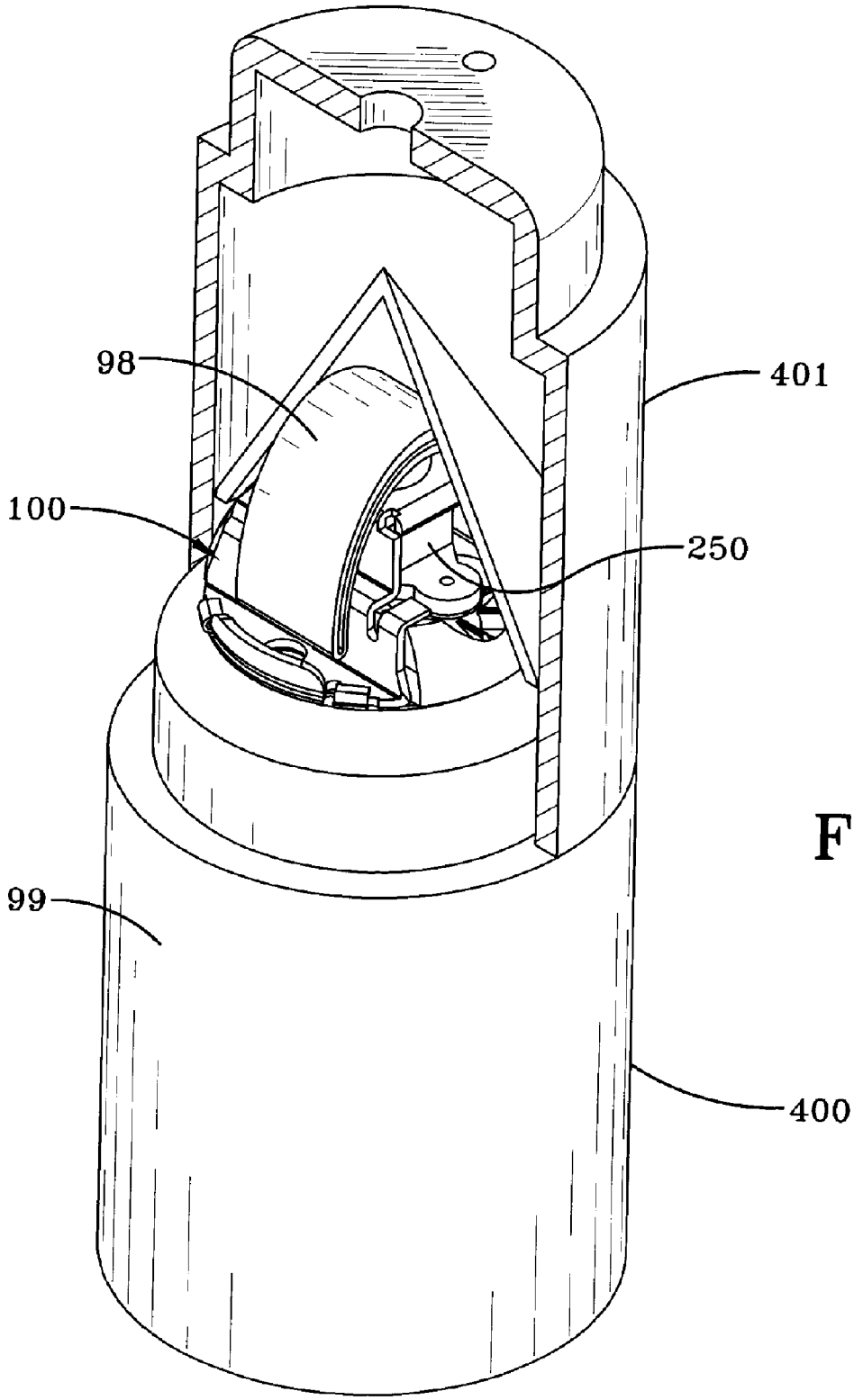
FIG. 3 is a side cutaway view of a fuze on a warhead with the fuze slider stowed and the ribbon nested inside the warhead of another grenade.

FIG. 3 is a side cutaway view of a grenade 400 having its fuze 100 on a warhead 99 with the fuze slider 250 stowed and the ribbon 98 nested inside the bottom of another grenade 401. In general, the interior of a cargo round (not shown) will include many rows of stacked grenades. The grenades are stacked inside the cargo round such that the fuze of one grenade, including the folded stabilizer ribbon 98, can nest inside the warhead of the grenade stacked above, as shown in FIG. 3. In the stacked configuration of FIG. 3, fuze slider 250 is unable to extend out of the housing 150. Thus, the fuze 100 cannot be armed while stacked in the cargo round. When dispensed at high airspeed from the cargo round, the grenade 400 tumbles in the airstream and is righted and slowed by drag from the unfurled stabilizer ribbon 98, as shown in FIG. 2.

FIG. 2 is an isometric view of a grenade 400 having a fuze 100 mated to a grenade warhead 99. In FIG. 2, the grenade 400 has been dispensed from the cargo round. The unfurled stabilizer ribbon 98 includes a pin (not shown) that fits in an opening in the fuze slider 250. As drag force acts on ribbon 98, the ribbon 98 pulls the pin free of the fuze slider 250. A spring forces fuze slider 250 into the airstream. The output explosive charge 80 of the S&A device 200 (which moves with slider 250) is then positioned so that its explosive output will be directed downward into the munition warhead 99.

In prior art fuzes, twisting motion of the ribbon 98 was required to remove a threaded pin from the fuze slider 250. As discussed earlier, ribbon twist may occur in unintended situations, thereby freeing the fuze slider 250. In the invention, it is preferred that the ribbon pin is not threaded so that drag rather than twist is required to remove the ribbon pin from the fuze slider 250. However, in light of the numerous other safety features of the invention, fuze 100 may safely function using a ribbon pin that is removed from the fuze slider 250 by twist, rather than drag.

Figure 4:
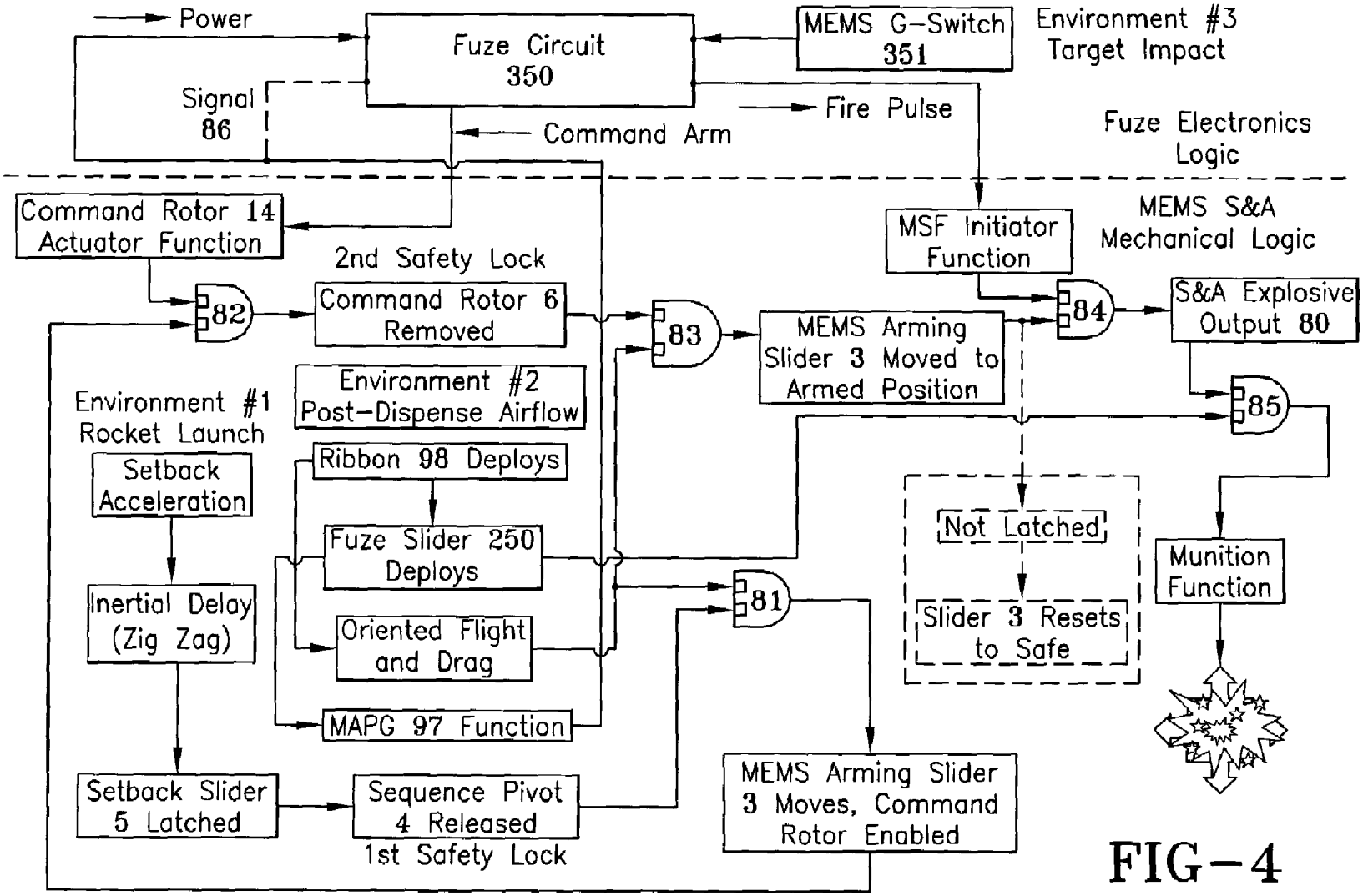
FIG. 4 is a safety and arming block diagram.

FIG. 4 is a safety and arming block diagram for the fuze 100. The safety of the fuze 100 is in part a result of its mechanical and electro-mechanical logic. Environmental stimuli follow a unique pattern of direction, threshold, sequence, and duration to effectuate the arming sequence. Environmental inputs that do not match the launch/dispense sequence or meet minimum thresholds result in one of two outcomes: a) The mechanical logic elements may partially respond to the inputs and then reset (e.g. by included springs that are tensioned or pre-biased toward safety) to their original "safe" (unarmed) position; or b) The mechanical logic elements may be allowed by the mechanism to partially respond to the inputs, and then due to the out-of-sequence or improper nature of the inputs the mechanical elements may finish in a "failed safe" condition, as will be explained. Before describing FIG. 4 in detail, the S&A device 200 will be described.

Figure 7:
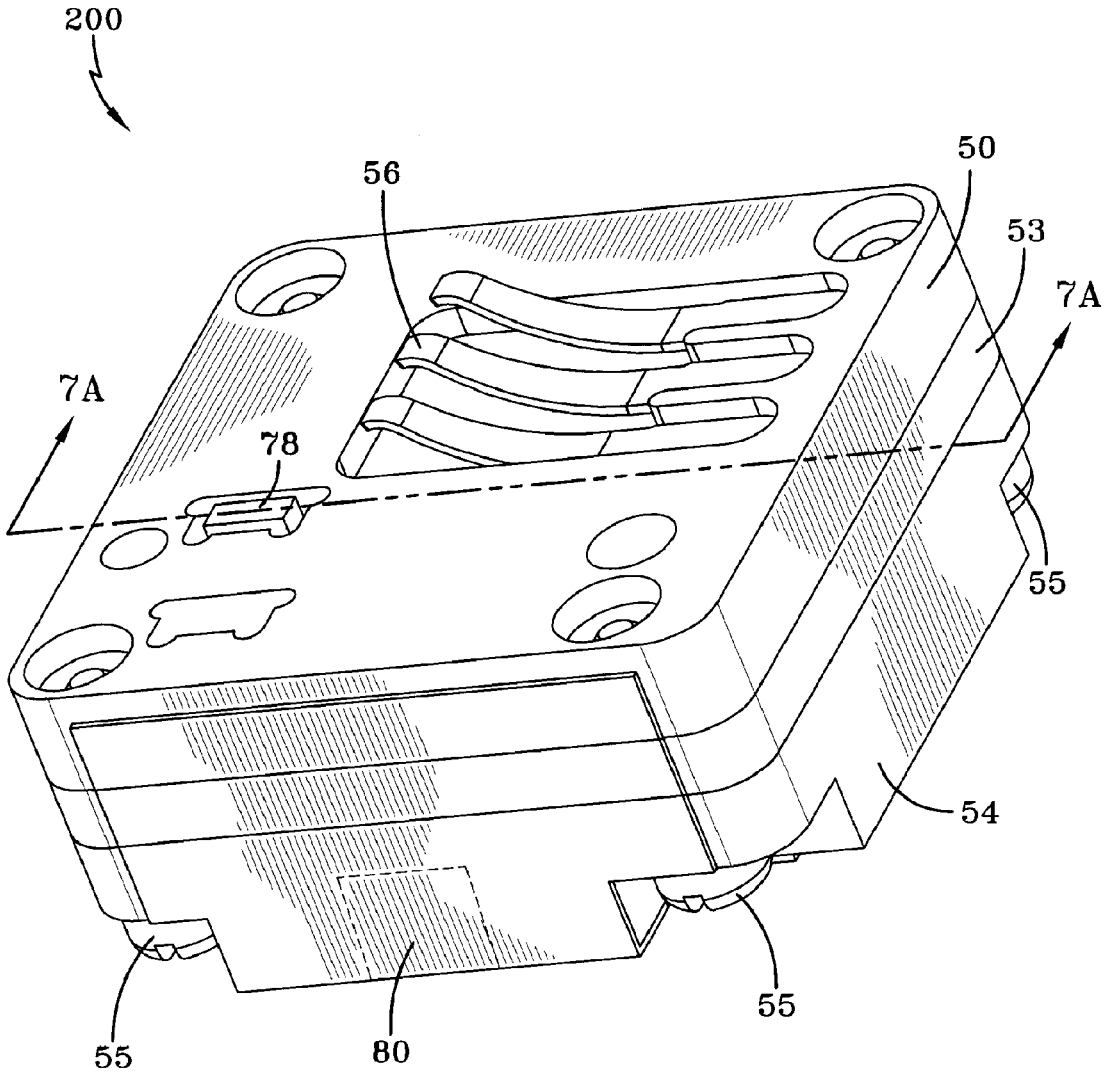
FIG. 7 is an isometric view of the assembled MEMS safe & arm device.
Figure 7A:
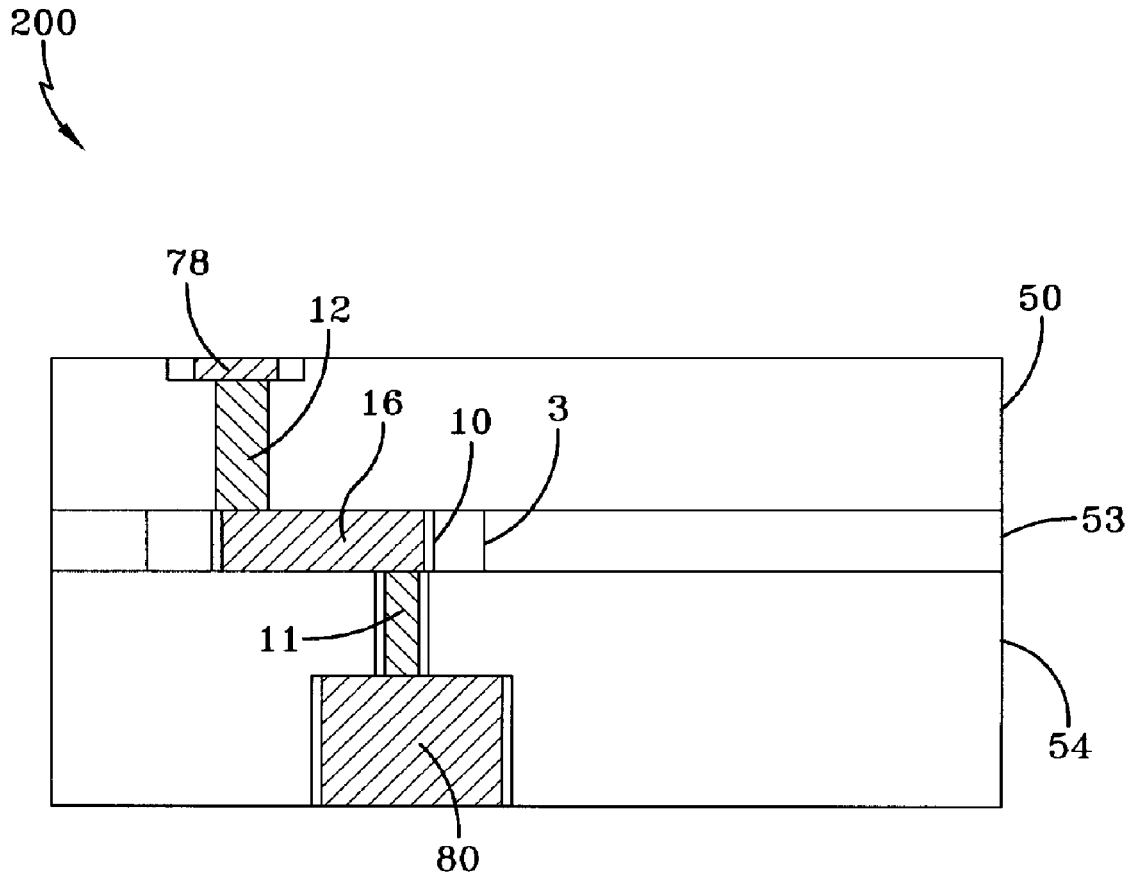
FIG. 7A is a sectional view along the line 7A-7A of FIG. 7.

FIG. 7 is an isometric view of the assembled MEMS S&A device 200. FIG. 7A is a sectional view along the line 7A-7A of FIG. 7. The S&A device 200 comprises a cover assembly 50, a MEMS mechanism layer 53 including a frame and substrate, and an explosive output assembly 54. The cover assembly 50, mechanism layer 53 and explosive output assembly 54 are held together by fasteners 55, such as screws, rivets, snaps or other type of packaging or fastening means. The S&A device 200 fits inside the fuze slider 250 and travels with it as the slider 250 moves from a safe (nested) to an armed (extended) position. The mechanism layer 53 of the S&A device 200 (FIGS. 5 and 13 through 15) manages the position of an essential element of the firetrain, the transfer charge 16 that fits into transfer charge pocket 10.

The function of the cover assembly 50 is to receive a fire pulse from the fuze circuit board 350 and use it to initiate the explosive train of the fuze 100. Contacts 56 may be used to connect with the fuze circuit board 350. An electrical pulse from the fuze circuit board 350 will ignite an initiator 78, such as a thin film bridge (TFB) initiator, which in turn ignites the input explosive column 12. The input explosive column 12 builds up to a detonating output that initiates the transfer charge 16 in the mechanism layer 53.

Figure 5:
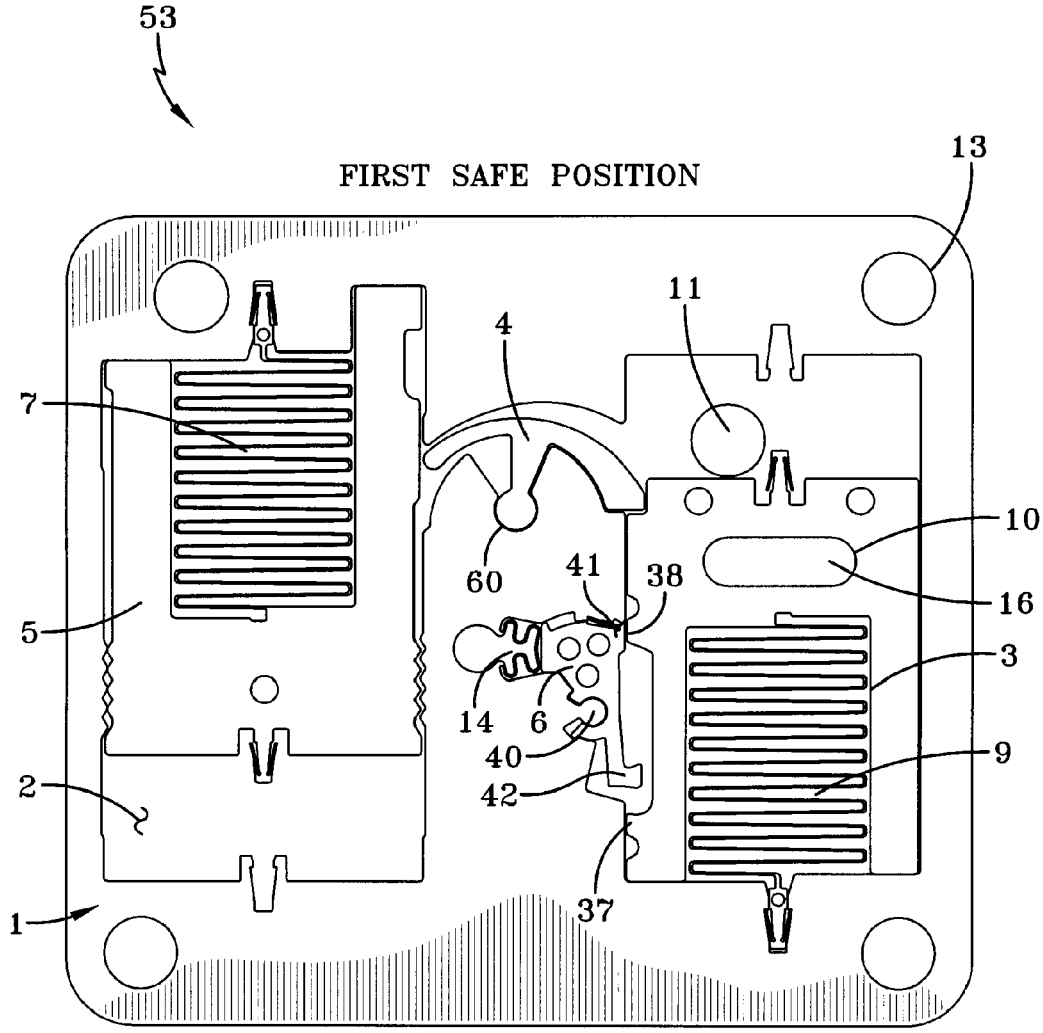
FIG. 5 is a plan view of one embodiment of a MEMS mechanism layer, with the arming slider in a first safe position.

FIG. 5 is a plan view of one embodiment of a mechanism layer 53, with the arming slider 3 in a first safe position. The mechanism layer 53 comprises a frame 1 containing pockets for the mechanism parts to work in, a planar substrate 2 upon which the frame 1 and mechanism parts interact, an arming slider 3, a setback sequence pivot 4, a setback slider 5, a command rotor 6, and a command rotor actuator 14. In a preferred embodiment, these parts are fabricated using known high-aspect-ratio (HAR) lithographic, electroplating and molding techniques that produce features in the micron to millimeter size range, in relief on a planar substrate, and released from or de-bonded from that substrate, and of a thickness or height above the substrate plane of approximately 300-um to 350-um. The arming slider 3 should have a thickness in this range to accommodate a suitably powerful explosive transfer charge 16 that can be physically moved to complete a firetrain. The setback slider 5, arming slider 3, setback sequence pivot 4 and command rotor 6 are thinner than the frame 1 to provide a working clearance. Setback slider 5 and arming slider 3 have bias springs, 7 and 9, respectively, that are pre-tensioned to predispose each slider in a direction away from arming. Holes 13 are through-holes through which fasteners 55 may pass to clamp the S&A device 200 together, as shown in FIG. 7.

The S&A device 200 is armed by moving the arming slider 3 upwards in FIG. 5 until the transfer charge 16 overlaps the output explosive column 11. In this position, the transfer charge 16 explosively couples the input explosive column 12 (FIG. 7A) and output explosive column 11 by laterally connecting them. The input explosive column 12 is located in the cover assembly 50 above the right end of the transfer charge 16 when the arming slider 3 is in the armed position. The input explosive column 12 will initiate the transfer charge 16 which will initiate the output explosive column 11. An exemplary micro-scale firetrain suitable for use in the present invention is disclosed in U.S. patent application Ser. No. 10/708,930 filed on Apr. 1, 2004, which is hereby expressly incorporated by reference.

If the arming slider 3 is not in the armed position, the transfer charge 16 is not aligned with either the input column 12 or the output column 11. If the input column 12 initiates with slider 3 in the unarmed position, the explosive front coming from the input column 12 will not impact the transfer charge 16, so that the transfer charge 16 does not detonate or ignite. Also, if the transfer charge 16 spuriously detonates or ignites while out of line (i.e., with the arming slider 3 in a safe position), its output would not impinge on the output charge 11. The explosive output of the transfer charge 16 in pocket 10 of the arming slider 3 in its armed position communicates with (propagates to) the output column 11 that is located in the underside of the substrate 2. Output explosive column 11 initiates the explosive output charge 80 (FIG. 7). The transfer charge 16 located in the transfer charge pocket 10 may be an energetic charge, or, if the desired output of the fuze 100 is a deflagration or ignition front, then transfer charge 16 may be a deflagration charge.

Figure 6:
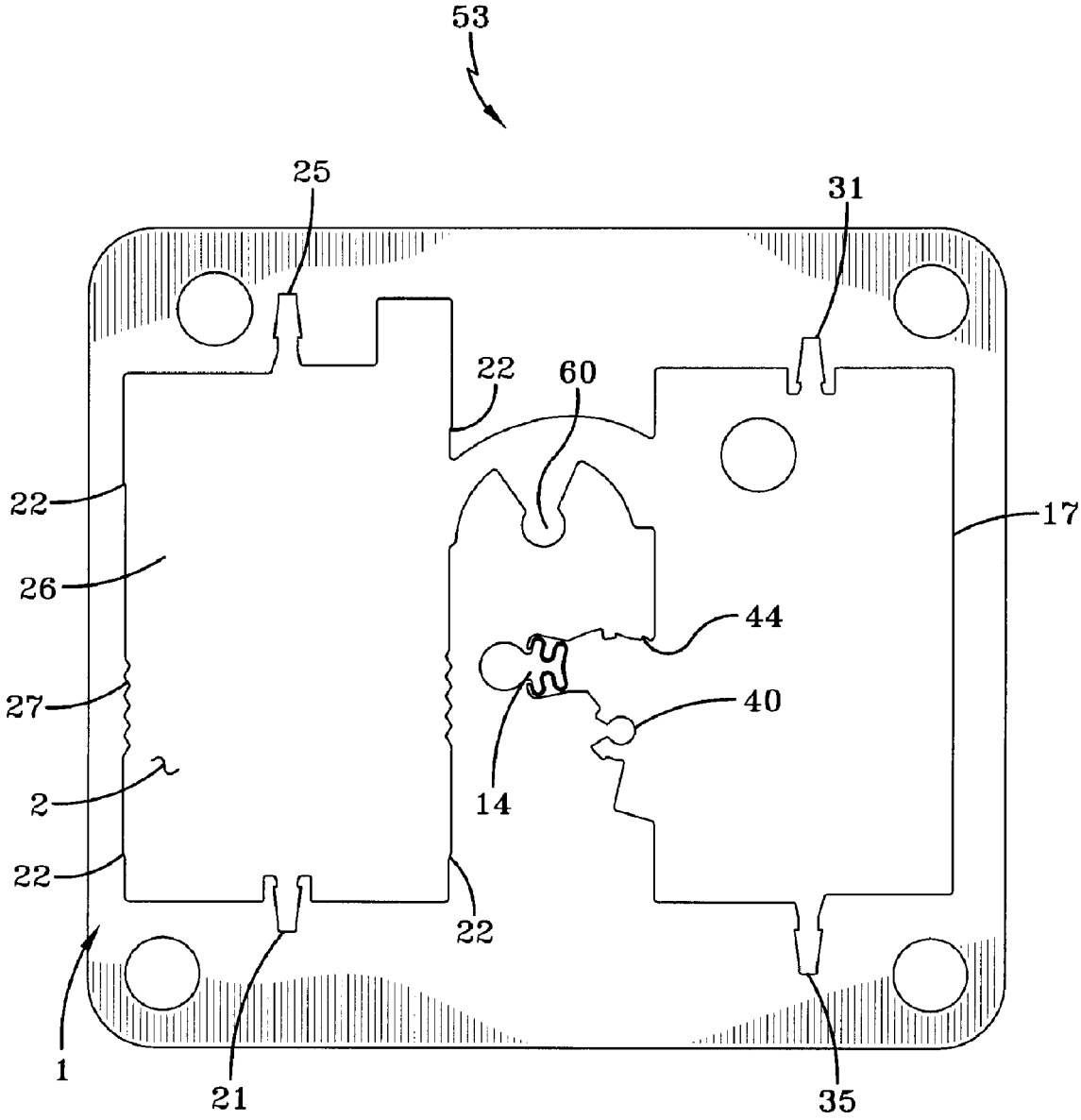
FIG. 6 is a plan view of the substrate and frame shown in FIG. 5.
Figure 8:
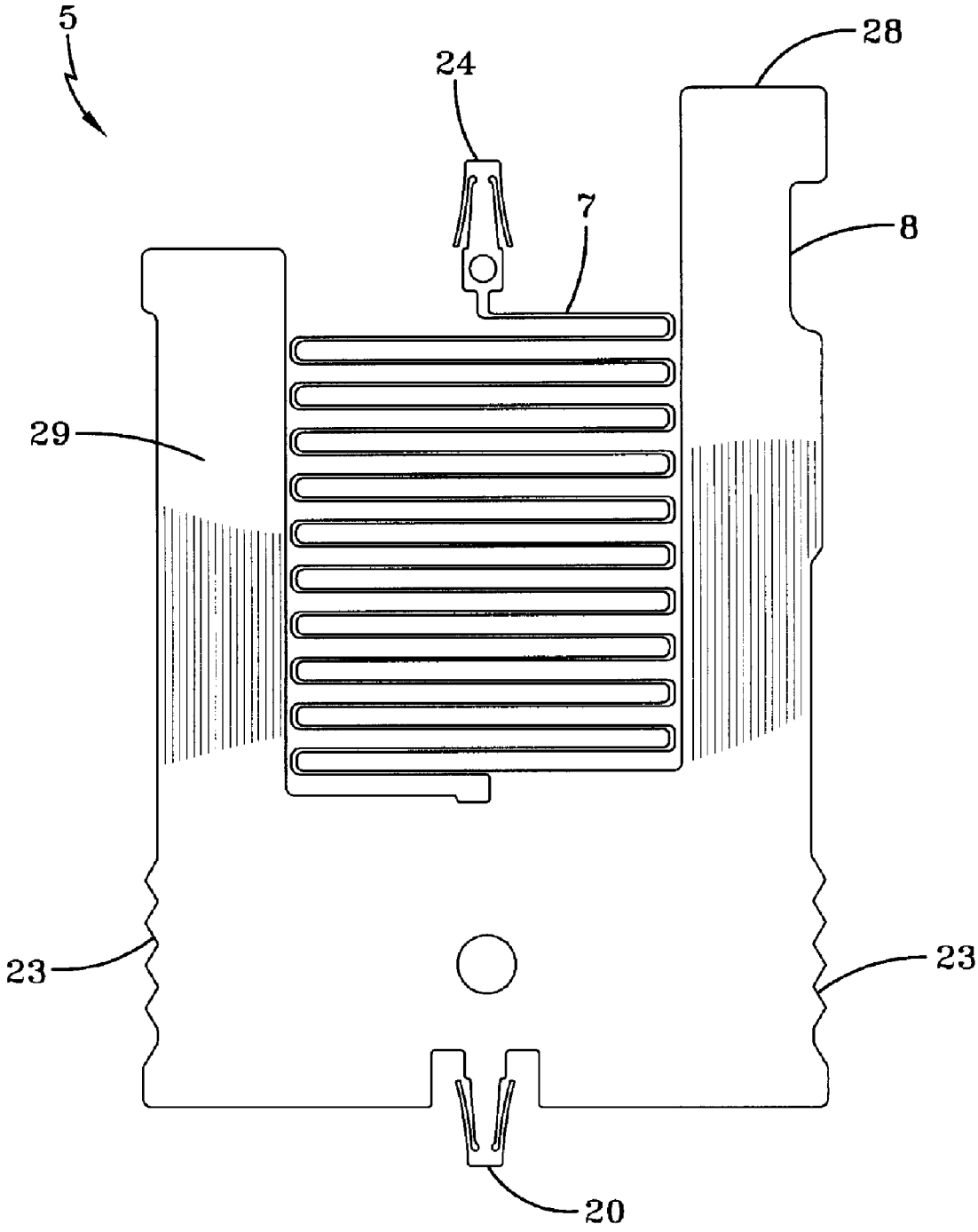
FIG. 8 is a plan view of the setback slider mass and spring.

FIG. 6 is a plan view of the substrate 2 and frame 1 shown in FIG. 5. The frame 1 rests on top of substrate 2 and constrains the motion of the moving parts of the mechanism layer 53. The frame 1 is preferably bonded to, or integral with, the substrate 2 and rises approximately 300 to 350-um above it. The setback slider 5, see FIG. 8, is constrained to move inside setback slider travel slot 26 between an upward position in which the slider bias spring head 24 is inserted into bias spring socket 25 to pull it into a normally upward position, and a downward position. To get to the downward position with slider latch head 20 engaged and locked in slider latch socket 21, the slider 5 must travel through inertial delay zigzag track 27 (on both sides of the slider 5 and frame track), which provides inertially-induced delay to the slider stroke when the slider 5 is induced downward by an inertial pulse of the frame 1. A full description of the inertial delay action can be found in U.S. Pat. Nos. 5,705,767 and 6,064,013. Tapers 22 (four places) help guide the setback slider latch 20 into latch socket 21.

FIG. 8 is a plan view of the setback slider 5. Setback slider 5 comprises a mass (the setback slider body itself), an integral spring 7 with latch head 24, a set of zigzag racks 23 for engaging with frame track 27, an end-of travel latch head 20, a left arm 29 and a right arm 28. Arms 28 and 29 increase the effective length of the setback slider 5 in the slot 26 to avoid mechanical jamming or cocking of the slider 5 in the slot 26. Setback slider sequence pocket 8 permits sequence pivot left arm 62 (FIG. 11) freedom to move leftward when the setback slider 5 is locked in the down position.

The setback slider 5 is designed with the bias spring 7 and the zigzag track engagement 23 and 27 so that the repetitive zigzag motions of the setback slider, as it is induced by an applied acceleration field to travel down the track, yields a programmed delay. This mechanical delay provides safety because the slider 5 will tend to move all the way down and latch for launch inputs, which are directional and sustained, but will not latch for the instantaneous or randomized shocks associated with transportation and handling.

Figure 9:
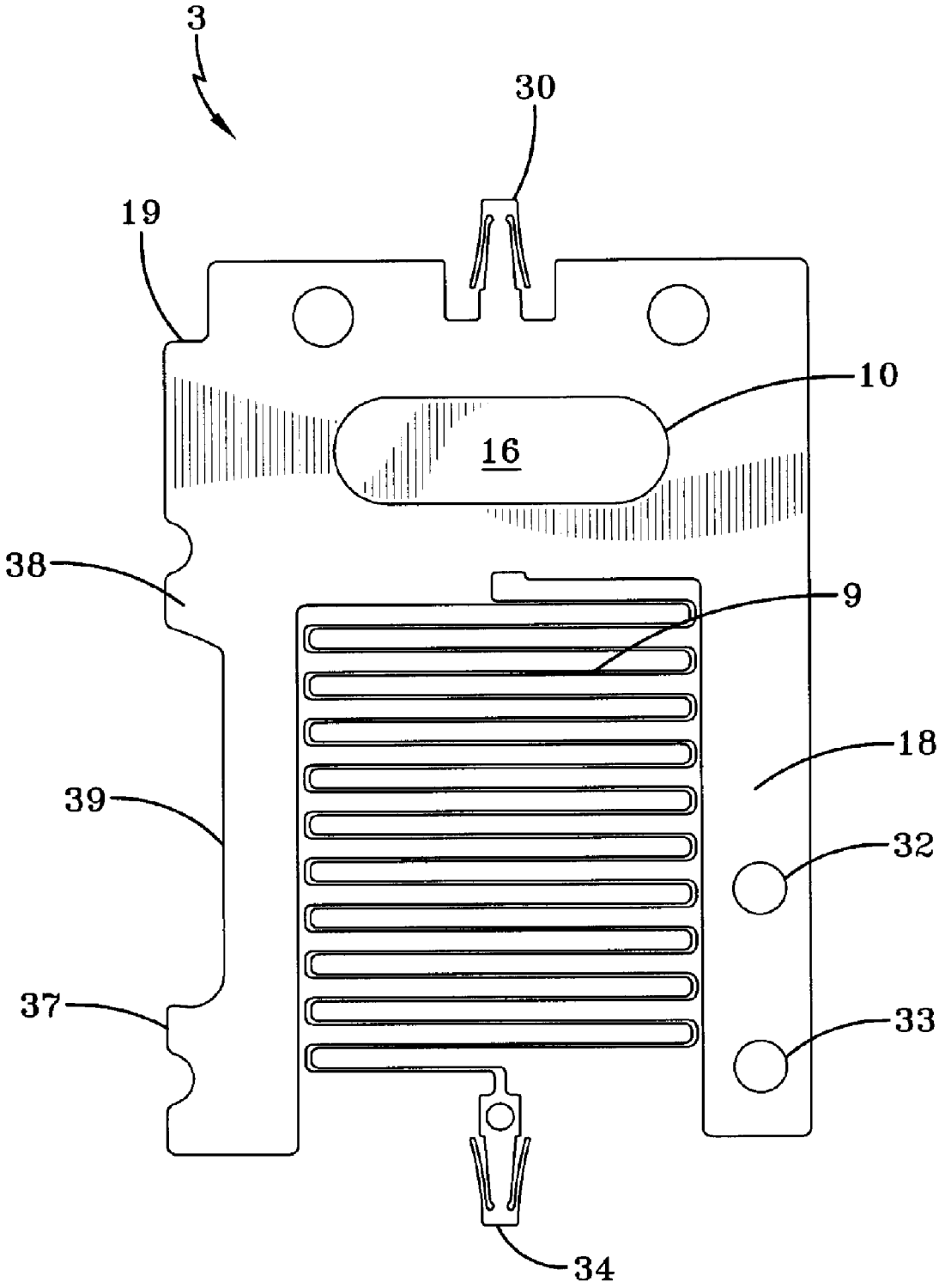
FIG. 9 is a plan view of the arming slider mass and spring.

FIG. 9 is a plan view of the arming slider 3. The arming slider 3 comprises a mass (the arming slider body itself), an integral spring 9 with spring bias latch head 34, an end-of travel arming slider latch head 30, a transfer charge pocket 10 for holding a transfer charge 16, an arming slider safety catch tab 37 and an arming slider safety sequence tab 38. Arms 39 and 18 increase the effective length of slider 3 in the slot 17 to avoid mechanical jamming or cocking of the slider 3 in frame slot 17. The spring 9 is nested in a pocket between the left arm 39 and the right arm 18 and is guided by them. Holes 32 and 33 are receptacles for color-coded arming status indicators or reflectors (not shown) that can be viewed through ports (shown as circles on S&A cover assembly 50 in FIG. 7) in the S&A assembly 200. Shoulder 19 catches on sequence pivot right arm 63 when the sequence pivot 4 is in its safe (CW) position, thereby holding the arming slider 3 in its first safe position.

When the arming slider 3 has been released by sequence pivot 4, it travels under drag acceleration upwards to a second safe position (FIG. 14), wherein command rotor foot 42 blocks further motion of the slider 3 by impinging upon arming slider safety tab 37. Another result of this same motion is that command rotor head 41 is no longer blocked by arming slider sequence tab 38, which means that the command rotor 6 is now "enabled".

The setback sequence pivot 4 (FIG. 5) rotates about the center of pivot socket 60. The command rotor 6 (FIG. 5) rotates about the center of rotor pivot head 40. When the command rotor 6 is extended by the command rotor actuator 14, its latch barb 43 (FIG. 10) engages with rotor latch indent 44 (FIG. 6). Arming slider 3 is normally held down by the tension of bias spring 9 having bias spring head 34 locked in bias spring head socket 35. Movement of the arming slider 3 is constrained by sequence pivot 4 and command rotor 6. When sequence pivot 4 and command rotor 6 are removed, the arming slider 3 can move inertially upwards until its latch head 30 inserts and latches into frame arming slider latch socket 31.

Figure 11:
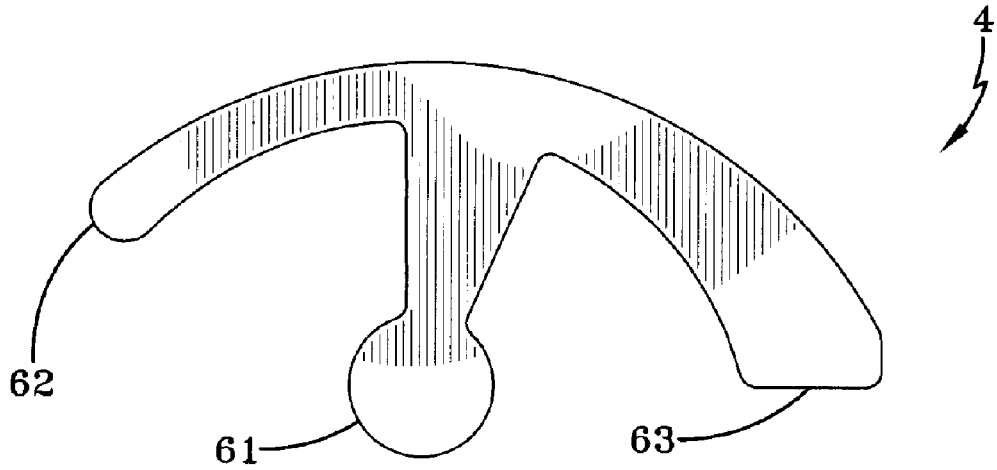
FIG. 11 is a plan view of the setback sequence pivot.

FIG. 11 is a plan view of the sequence pivot 4. The sequence pivot 4 provides a mechanical check on the arming slider 3, keeping it in its first safe position so long as the setback slider 5 has not advanced downward and latched in its armed position. The sequence pivot 4 is weighted so that during a setback acceleration (frame 1 accelerating upward in FIG. 5) the relatively heavy sequence pivot right arm 63 biases the rotor in a CW direction, that is, toward safety, because it blocks motion of the arming slider 3 toward arming.

Figure 10:
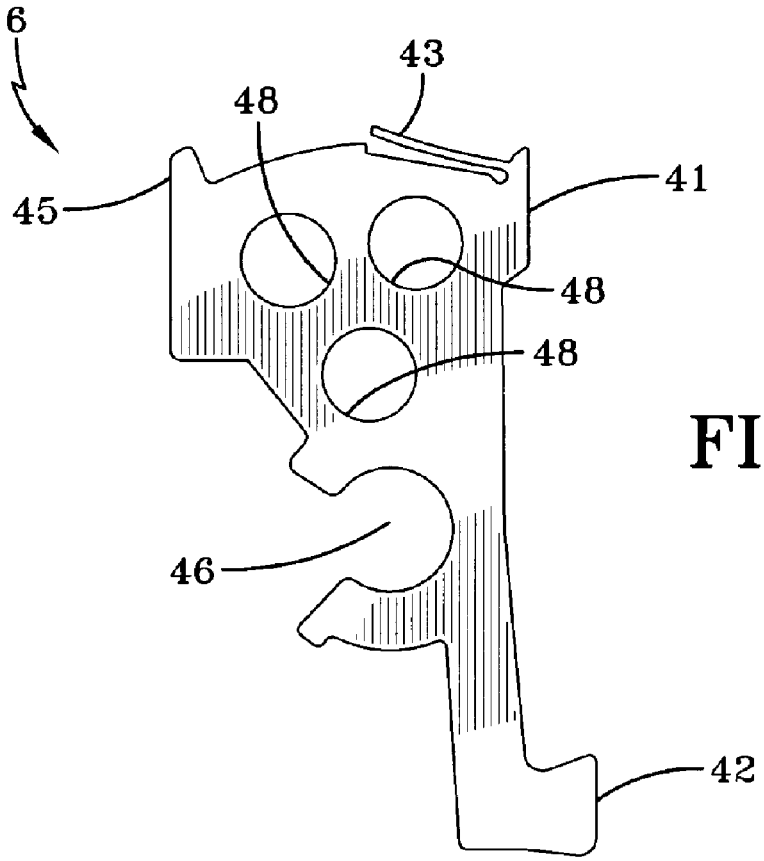
FIG. 10 is a plan view of the command rotor.

FIG. 10 is a plan view of the command rotor 6. Command rotor 6 has two functional positions. In a first functional position (the 'normal,' CCW, as-assembled position), the rotor foot 42 is extended into the pocket between arming slider safety-catch and sequence tabs, 37 and 38, respectively, such that if the command rotor 6 remains in this position it will prevent the arming slider 3 from advancing to the armed position. The rotor foot 42 will strike the arming slider safety catch 37. In this first functional position, there is another safety aspect provided by the command rotor 6 in relation to the arming slider 3. If a spurious or untimely command moves the command rotor actuator 14 before the arming slider 3 has moved upward to its enabling position, the command lock rotor head 41 (FIG. 10) will jam against the arming slider sequence tab 38, preferably locking it in place. Also, once this happens, the rotor foot 42 will remain in the safe (CCW) position indefinitely.

The command rotor actuator 14 may be, for example, a bellows type actuator, as shown in the Figs. Other types of actuators may also be used. Upon command from the fuze circuit board 350, fuze power initiates a small quantity of pyrotechnic that has been pre-positioned inside a recess in the S&A cover assembly 50. The recess in the S&A cover assembly 50 interfaces and shares a common volume with command rotor bellows actuator 14. Alternatively, the pyrotechnic may be placed directly in the bellows 14. The gases produced by the pyrotechnic rapidly expand the bellows 14 to push rightward upon the head 41 of command rotor 6.

The command rotor's second functional position (FIG. 14) occurs after the arming slider 3 has moved upwards in response to set-forward (air drag) acceleration, such that arming slider safety tab 37 is pushing against command rotor foot 42. At the same time, sequence tab 38 ceases to interfere with rotor head 41 thereby "enabling" the command rotor 6. In this situation the pyrotechnic charge can expand bellows 14 to drive command rotor 6 CW, driving rotor foot 42 out of the way of the arming slider 3. As this happens, rotor latch barb 43 is dragged past rotor latch indent 44 (FIG. 6) and becomes engaged therein, preventing rotation of the command rotor 6 back into the safe position, and thereby preventing the arming slider 3 from returning to the all-safe position.

Fast action of the command rotor 6 is necessary, so mass-reducing holes 48 may be made in portions of the rotor 6 to reduce rotational inertia. Also, to improve dynamic seal of the rotor head 41 against pyrotechnic product gases, command rotor seal tab 45 is provided as a sealing feature.

Figure 12A:
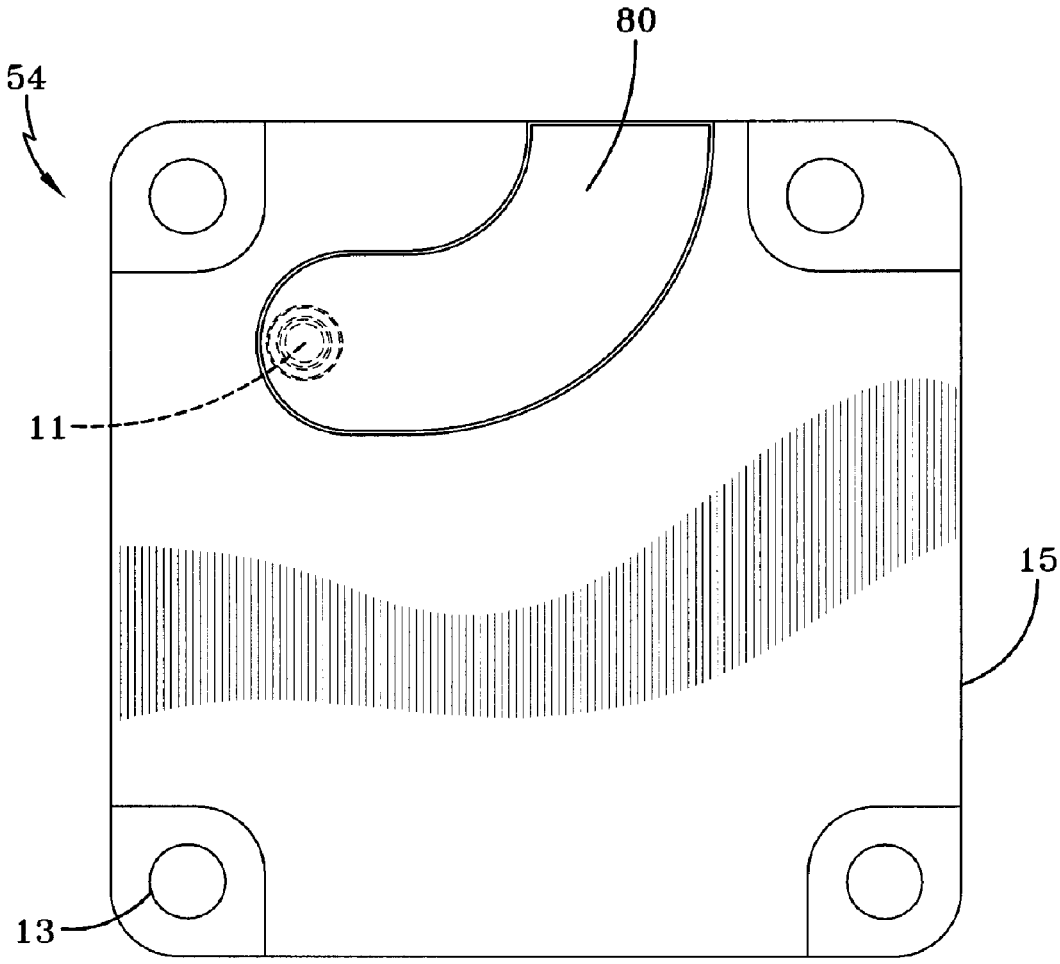
FIG. 12A is a plan view of the explosive output assembly.
Figure 12B:
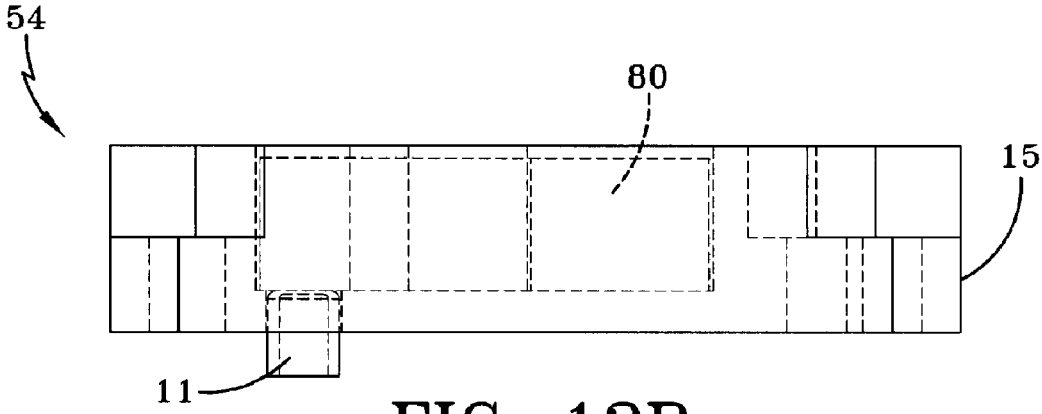
FIG. 12B is a front view of FIG. 12A.

FIG. 12A is a plan view of the explosive output assembly 54, which is part of the S&A device 200 (FIG. 7). FIG. 12B is a front view of FIG. 12A. The explosive output assembly 54 comprises S&A base plate 15, an explosive output charge 80 and an explosive output column 11. When the transfer charge 16 of arming slider 3 is initiated (with slider 3 in the armed position), its energetic output detonates output charge 11. Charge 11 carries and enhances the detonation reaction such that it impinges onto an end of explosive output charge 80. Charge 80 is typically confined in a slot in base plate 15. The explosive output of charge 80 is directed to a receiving explosive element in the grenade warhead 99, thus detonating the grenade warhead. If an output other than detonation is desired from the fuze 100, charge 80 may be replaced with a deflagrating mix or an incendiary or other chemical mix, for example. The output end of charge 80 can also be seen in FIG. 7.

There are, of course, many other ways to combine the above elements and functions that are merely rearrangements of the invention. Such rearrangements fall with the scope of the present invention. For example, in one rearrangement, the explosive initiation function and the explosive output charge 80 could both be integrated into the cover assembly 50, without compromising the safety or function of the overall device. Or again, the explosive initiation function could be integrated into the MEMS substrate 2. Also, other means of explosive initiation could be used in place of thin film bridges. There are also other means of integrating mechanical functions, for example, integral springs 7 and 9 need not necessarily be integral with their respective slider bodies. They may be fabricated in a separate precision process and then be attached or inserted into a feature such as a socket or key slot in their respective sliders such that they function identically to integral springs. This may enable the slider to be fabricated in a lower precision (cheaper) process.

FIG. 4 shows the logic of the arming and function of the fuze 100. The AND gates 81, 82, 83, 84, 85 are shown in FIG. 4 to illustrate the logic of fuze 100. However, the fuze 100 does not actually contain these AND gates 81-85 as physical structures. Note that the S&A frame 1 shown in FIG. 5 is oriented in the fuze 100 with its top edge toward the direction of flight, while the munition 400 (FIG. 2) is oriented with the stabilizer ribbon 98 trailing the direction of flight. During launch of the carrier round, setback acceleration (environment #1, rocket launch) occurs, inducing the setback slider 5 to move aft-ward against biased-toward-safety spring force in the setback bias spring 7. Slider 5 also must negotiate its way through the zigzag track 27. This zigzag motion of the setback slider 5 requires prolonged acceleration to traverse the full zigzag track 27. If the setback acceleration level decreases before the setback slider latch head 20 locks in the latch socket 21, the bias spring 7 will return the setback slider 5 back to the starting point, which is the safe position.

Figure 13:
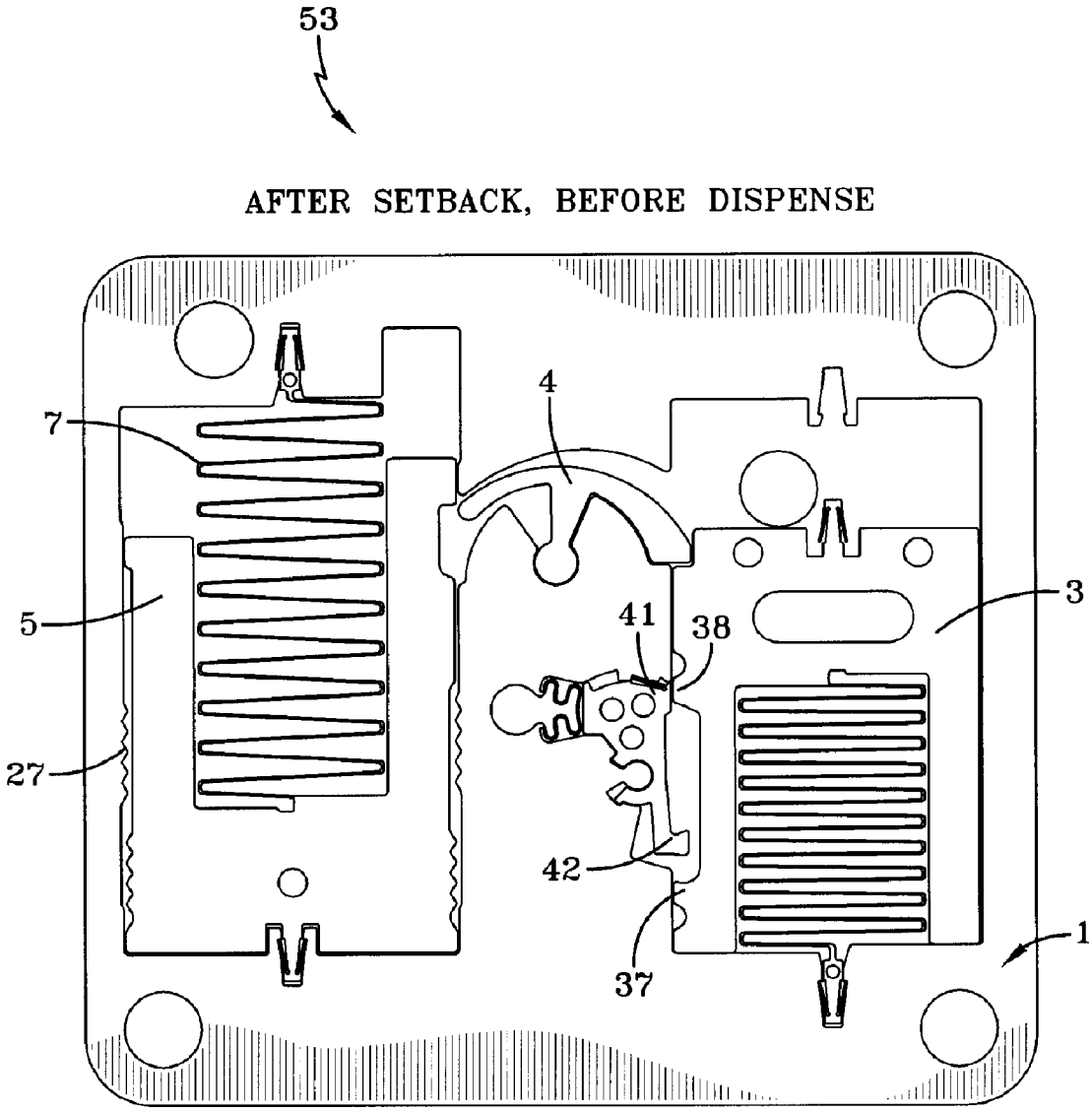
FIG. 13 is a plan view of the MEMS mechanism layer just after setback acceleration.

With setback acceleration sufficient to latch the setback slider 5, the sequence pivot 4 is free to pivot in socket 60 to release its hold on arming slider 3, thus removing the first safety lock on the arming slider 3, see FIG. 13. After the grenades 400 are dispensed from the carrier round (post-dispense airflow, environment #2), the stabilizer ribbon 98 deploys. Ribbon 98 orients, slows, and stabilizes the munition 400 in its free-fall and deploys the fuze slider 250. With the fuze slider 250 deployed into the air stream, the MAPG 97 provides electrical power and a signal 86 to the fuze circuit board 350. Signal 86 is derived from the MAPG 97 power feed and is indicative of the deceleration of grenade 400.

Meanwhile, the two inputs to AND gate 81 have been realized. First, the sequence pivot 4 is released and second, the oriented aerodynamic drag above a certain threshold is continuing, which permits the arming slider 3 to move slightly upward in its track 17 to where its sequence tab 38 clears the head 41 of command rotor 6 (FIG. 14), thereby "enabling" the command rotor 6 to be moved at a later time, by action of command rotor actuator 14.

Figure 15:
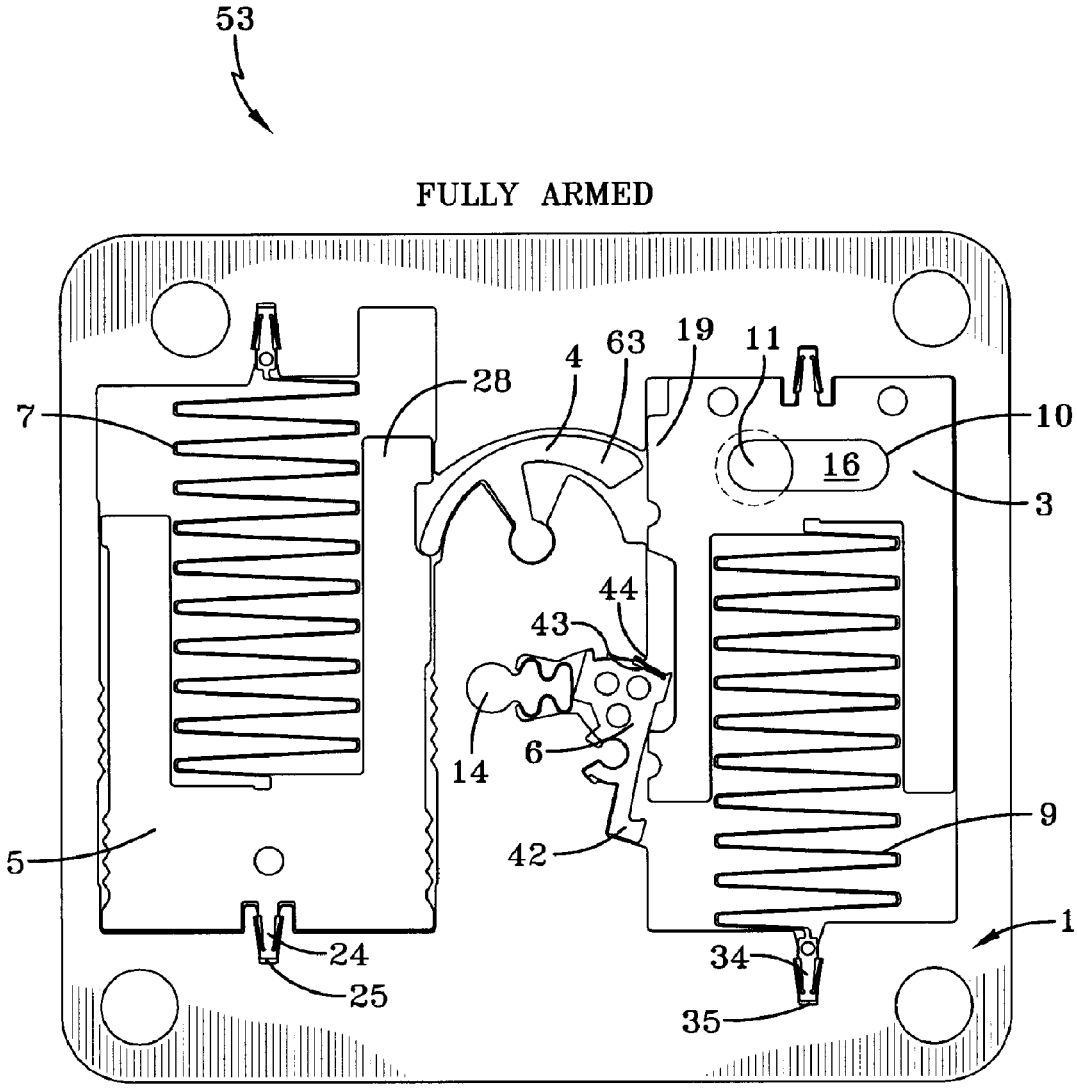
FIG. 15 is a plan view of the MEMS mechanism layer with the arming slider in its armed position.

After the signal 86 has been evaluated for proper characteristics and the fuze circuit board 350 and its integrated fire circuit has been charged, the fuze circuit board 350 gives a command arm function to the S&A device 200. This condition, along with command rotor enable, feeds into AND gate 82, with the output being that the foot 42 of command rotor 6 is now removed, see clockwise rotated position of command rotor 6 in FIG. 15. If the oriented drag and flight deceleration is still greater than the spring bias force of arming slider bias spring 9 when the foot 42 of command rotor 6 is removed, both these inputs feed into AND gate 83, with the result that arming slider 3 moves into the armed and latched position as shown in FIG. 15. The S&A device 200 is now mechanically armed and energized.

Figure 14:
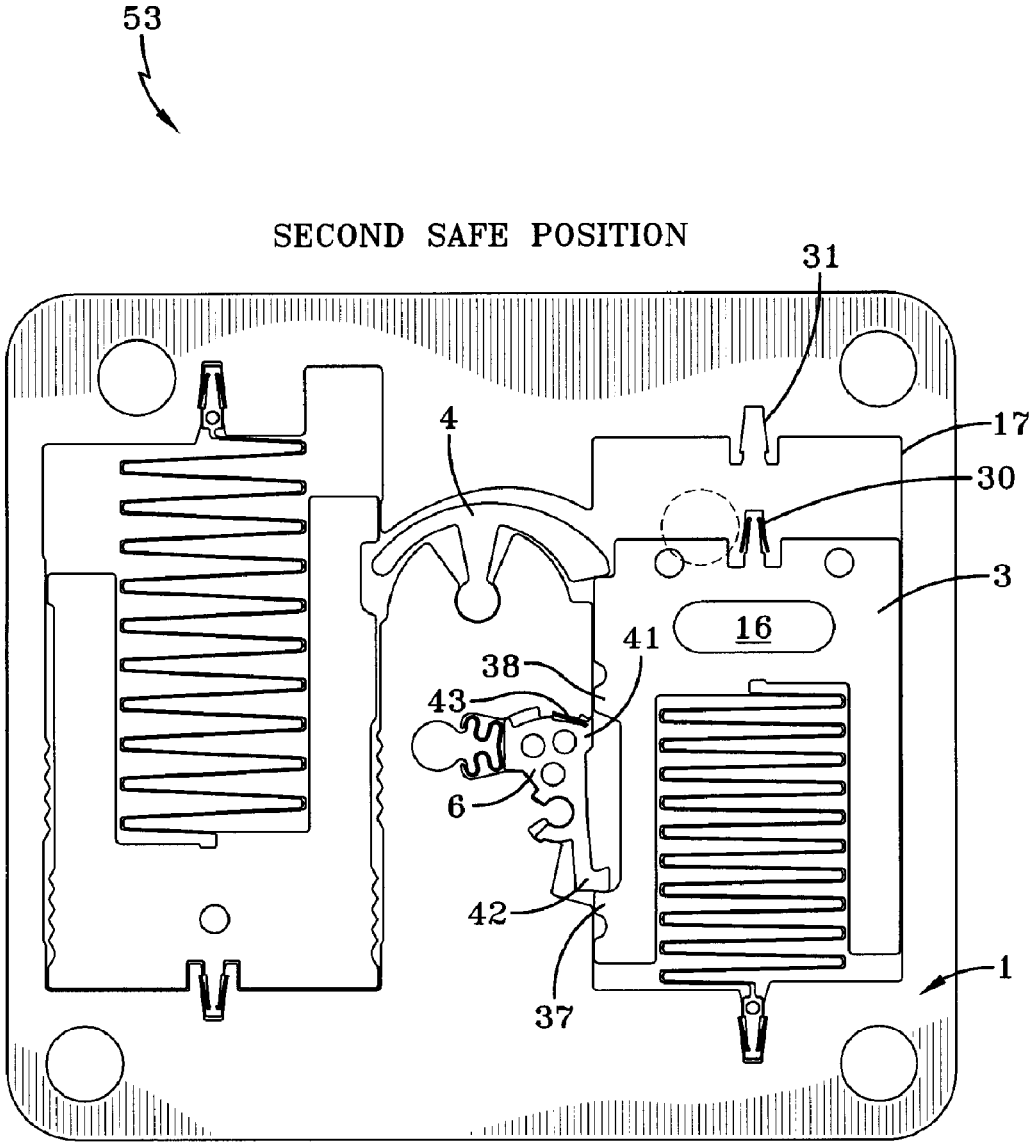
FIG. 14 is a plan view of the MEMS mechanism layer after munition dispense and with the arming slider in a second safe position.

Note that if the deceleration level acting on the arming slider 3 decreases before the arming slider latch head 30 locks into the latch socket 31, the bias spring 9 will return the arming slider 3 back to an un-armed position, see FIG. 14. If the MAPG 97 is still providing proper electrical power and signal 86 to the fuze circuit board 350, the fuze circuit will charge the fire capacitor and wait for the omni-directional G-switch 351 closure. Upon G-switch closure (environment #3, Target Impact), the fuze circuit will discharge the fire capacitor and send a fire pulse to the micro-scale fire train (MSF) initiator 78 (FIGS. 7 and 7A) located in the cover assembly 50 of the S&A device 200. The MSF initiator 78 is, for example, a thin film bridge (version of hot wire) used to electrically initiate primary explosives.

If the MSF initiator 78 functions while the arming slider 3 is in the armed position, then the inputs to the AND gate 84 are realized. The firetrain in the S&A assembly 200 then produces its explosive output via charge 80. If the fuze slider 250 has remained deployed or extended, then the two inputs into AND gate 85 are realized (that is, the S&A explosive output charge 80 is mechanically lined up with the input charge of the warhead 99) and the warhead 99 explodes.

Operation of the Preferred Embodiments

Before the launch sequence is initiated, the fuze 100 is considered to be in the safe state. In the safe state, there exists no stored electrical energy in the grenade assembly 400. The grenade assembly 400 is nested head to toe with other grenade assemblies such that the fuze end of one grenade is enveloped inside the hollow end of the munition body 99 of the next grenade in the stack, FIG. 3. The fuze slider 250 in FIG. 3 is held in the retracted position within the fuze housing 150 and the pre-folded stabilizer ribbon 98 is held compactly by virtue of the nested configuration. The MEMS-Based S&A explosive output charge 80 and the warhead 99 transition charges are not aligned so that if all or any explosive charges within the S&A device 200 were to unintentionally initiate, transfer to the warhead 99 explosive charges would be prevented.

As shown in FIG. 5, within the MEMS S&A device 200, slider springs 7 and 9 are tensioned with spring bias latch heads 24 and 34 securely engaged in latch pockets 25 and 35. Setback slider 5 and arming slider 3 are held in the safe positions by the spring tension. Safe position for the setback slider 5 is fully upward and for the arming slider 3 is fully downward. Direction of flight is always upwards in FIG. 5, so that when launch acceleration occurs it will tend to move slider 5 downwards toward latching and when post-dispense drag occurs it will tend to move slider 3 upward toward arming. Setback sequence pivot 4 is fully rotated clockwise and retained in that position by the presence of the setback slider 5. In this position the sequence pivot right arm 63 is engaged with the arming slider shoulder 19 to prevent movement of the arming slider 3.

The command rotor foot 42, see FIG. 10, is in the fully counterclockwise position, being held there by the presence of the safe-positioned arming slider 3. Contact is made between the command lock rotor head 41 and the arming slider sequence tab 38. The command lock rotor foot 42 is engaged in a recess in the arming slider left arm 39 such that movement of the arming slider 3 is prevented past a small initial distance. By virtue of the arming slider 3 being in a first (lower-most) safe position, the transfer charge pocket 10 with the emplaced transfer charge 16 is not lined up with the explosive train input and output columns 12 and 11 respectively. If the input explosive column 12 were to inadvertently react or detonate, this out-of-line positioning of explosive components prevents transfer of the reaction to the arming output charge 11 and subsequent explosive components and is one determination of the safe or armed state of the overall fuze and munition.

When the events and environments of the launch-to-target sequence, including launch, carrier round flight and grenade dispense have been detected in the correct order by the fuze 100, the fuze 100 will perform its functions and ultimately achieve an armed state. Upon launch of the carrier round, S&A device 200 undergoes setback acceleration (environment #1) resulting in a velocity change sufficient to drive the setback slider 5 down through its zigzag delay track 26 and 27 to the end of travel in its slot where it latches in place with latch head 20. This motion allows the first lock (the setback sequence pivot 4) that engages arming slider 3 to be pushed out of the way by the arming slider 3, when the acceleration field reverses due to air drag.

Typically a center-core burster inside the carrier round ejects the stacks of grenades 400 out through the side of the round. In some arrangements, the grenades 400 are thrust out the front or the rear of the cargo round. As the stacked grenades 400 become de-nested and tumble in the air-stream, the stabilizer ribbon loop 98 on top of each grenade 400 unfurls and begins to catch air and slow down the fall speed of the grenade 400.

The grenade 400 is jettisoned in no exact orientation out of the carrier round at high speed relative to the ground. With high slipstream velocity acting on the stabilizer ribbon 98 creating significant drag, the grenade 400 is quickly oriented to point the warhead 99 downward along the slipstream. The aerodynamic drag axis corresponds very closely with the axis or direction of motion of the arming slider 3. Drag-induced tension in the ribbon 98 pulls a captured pin out of its engagement with the fuze slider 250. This allows the spring-loaded fuze slider 250 to push radially outward, which simultaneously puts the MAPG 97 into the air-stream and aligns the S&A device 200 explosive output charge 80 with the "lead charge" of the submunition warhead 99. But the fuze 100 is not yet in an armed state, because mechanical arming is controlled inside the S&A device 200.

In response to low-g, long-duration deceleration due to air-drag on the ribbon 98 and body 400, which constitutes safe and arm environment #2, the arming slider 3 moves upward in its track due to drag forces and loads the arming slider safety catch 37 against the command rotor foot 42, forming a second lock in slider 3. The sequence tab 38 of slider 3 is now clear of command rotor head 41 (FIG. 14). Also, when the MAPG 97 is extended into the air-stream, it generates electric power and energizes the fuze circuit. It also generates a MAPG signal 86 (e.g. frequency and amplitude) that is characteristic of the grenade flight and deceleration curve. This signal information is evaluated by the fuze circuit board 350 as a necessary criteria for a command arm and/or output fire pulse decision by the circuit.

Once the correct airflow signal is detected, the fuze circuit board 350 permits charging of the firing capacitor(s). The fuze circuit subsequently triggers a firing capacitor to dump its charge and initiate a gas-producing pyrotechnic charge. The initiation of the pyrotechnic charge is the command arm signal from the fuze circuit board 350 to the command rotor actuator 14. The gases from the pyrotechnic charge produce a rapidly rising pressure state which causes the bellows 14 to expand rightwards and push against the rotor seal tab 45 (FIG. 10) of the command rotor 6. The rotor 6 freely rotates in the clockwise direction and clears the rotor foot 42 out of the path of the arming slider safety catch 37, thereby removing the second and final lock on the arming slider 3.

If deceleration due to air-stream insertion is still present, the arming slider 3, now released and inertially driven, completes a movement up the slider travel slot 17 that aligns transfer charge 16 with the input and output explosive columns 12 and 11 and latches, thereby arming the fuze 100. In the meantime, the MAPG 97 charges a firing capacitor in the fuze circuit board 350. At this point the munition 400 is armed and ready to function on target.

FIG. 15 shows the working parts within the S&A device 200 configured in the fully armed position. Slider springs 7 and 9 are stretched out but still tensioned with spring latch heads 24 and 34 securely engaged in latch pockets 25 and 35. Setback slider 5 and arming slider 3 are held in the armed positions because inertial forces have propelled them along their respective tracks (at different times) in the S&A frame 1 and caused them to latch. Armed position for the setback slider 5 is fully downward and for the arming slider 3 is fully upward. Sequence pivot 4 is fully rotated counterclockwise and is retained in that position by the absence of the setback slider right arm 28 and the presence of the arming slider shoulder 19 against the sequence pivot right arm 63.

Command rotor actuator bellows 14 has fully expanded, having seen sudden and substantial rise in internal pressure from the reaction of the pyrotechnic gas-generating mix, and has pressed the head of command rotor 6 in a clockwise direction, to the extent that command rotor latch barb 43 is engaged in command rotor latch indent 44. This latch engagement keeps the command rotor 6 in an enabling position for arming slider 3 travel. The command rotor foot 42 is disengaged from the recess in the arming slider left arm 39 such that the arming slider 3 can move past it freely to reach the armed position. Command rotor foot 42 is now out of the path of the arming slider 3.

Continued drag-induced deceleration (i.e., set-forward acceleration) induces the arming slider 3 to move to its upper-most armed position. When in this position, the arming slider 3 holds transfer charge pocket 10 with the emplaced transfer charge 16 in a position lined up with the explosive train input column 12 and output column 11. If the input column 12 were to now react or detonate, this aligning of explosive components enables transfer of the reaction to the S&A explosive output charge 80, and subsequently detonates the explosive grenade warhead 99.

The armed free-falling submunition 400 will impact a target (environment #3, Target Impact). Upon impact, the omni-directional g-switch 351 is closed. Closing the g-switch 351 causes the firing capacitor in the fuze circuit board 350 to discharge and fire the MSF initiator 78, causing detonation of the grenade warhead 99. The omni-directional g-switch 351 may be arrayed so that it can detect multiple impact threshold levels or different thresholds in different directions. The small size and low cost of the g-switches makes it possible to include a "gang" of switches. Using a gang of switches, a grenade can detect and differentiate hard and soft targets. The fuze electronic logic may be programmed for such a configuration. This design would accommodate multi-modal grenade warheads, for example.

There are several scenarios that may cause a non-functioned submunition 400 to remain in the target area. If the submunition 400 arms correctly but the target impact is not sensed or the omni-directional g-switch 351 fails to close on impact, the fuze 100 will fail to function. This would leave a mechanically armed grenade 400 on the ground, but the grenade would very shortly have no electrical energy available to initiate the fire train, because the firing circuit bleeds down its voltage because of a bleed resistor in the fuze circuit board 350.

Before deployment, the munition 400 may be exposed to several types of dynamic inputs as a result of transportation and handling. These include impacts from handling drops and vehicle vibration as well as other inputs. The mechanical logic of the fuze 100 discriminates spurious inputs from valid launch inputs. The fuze 100 allows a partial response followed by a resetting to a starting or "ready" position as a result of the following inputs or events. When a setback acceleration force induced on setback slider 5 exceeds the bias threshold of pre-tensioned spring 7, the setback slider 5 is drawn downward in setback slider travel slot 26. If the setback pulse is too short in duration, the slider 5 does not go very far because of the interruption of motion due to the zigzag track 23 engagement, and the spring 7 draws the slider 5 back up the track 26 into the start position. If the setback pulse is too low in magnitude, the slider 5 only goes partway down the track 26 in static deflection, and when the acceleration field desists it is similarly drawn upwards once again by the biased spring 7 back into its start position.

Thus, the response to setback inputs that are too low or too brief, is that the setback slider 5 deflects only partway and then re-sets to its start position, ready to respond to the next inertial input. If the arming slider 3 sees spurious inputs in the direction of arming, there are two locks (setback sequence pivot 4 and command rotor 6) on it to prevent movement. If for some reason both lock mechanisms are missing or otherwise released, the arming slider 3 is still held in the safe position by biased spring 9 and will reset to its starting point if partial movement results from a low level input.

The mechanical logic of the invention will force a fail-to-safe condition as a result of the some inputs or events. Safety is preserved in the S&A device 200 in a case where there is a premature command-arm signal from the fuze circuit board 350 that tries to actuate the command rotor 6. Rotor 6 is blocked from moving by the arming slider sequence tab 38, FIG. 5. The arming slider 3 cannot become enabled or armed simply by an untimely command-arm signal because the sequence pivot 4 and bias spring 9 are holding it down.

Safety is also preserved in a case where a fire signal is sent to the micro-scale firetrain prematurely, before arming is complete. If a premature fire signal occurs before mechanical arming of the S&A device 200, no reaction will transfer from the input explosive column 12 to the output explosive column 11, because the transfer charge 16 in transfer charge pocket 10 is not aligned with either charge. This gap in the microscale firetrain prevents initiation of the warhead 99. The effectiveness of this firetrain arrangement has been demonstrated in laboratory and ballistic testing of a similarly enabled firetrain. It has also been demonstrated that, in the event that arming slider 3 is left out or missing, the unintentional initiation of the input column 12 still will not transfer and ignite output column 11 across the gap or void left by the missing slider 3, thus retaining safety of the fuze 100 and warhead 99.

The setback slider 5 cannot be assembled in the frame 1 in a reverse orientation, nor can it be mistakenly inserted into the arming slider slot 17. The arming slider 3 cannot be assembled in the frame 1 in a reverse orientation, being prevented by the interlocking command rotor 6 and the setback sequence pivot 4. The sequence pivot 4 cannot be assembled in the frame 1 in a reverse orientation. The command rotor 6 cannot be assembled in the frame 1 in a reverse orientation. The cover assembly 50 cannot be assembled in an incorrect orientation because of asymmetrical assembly holes.

During manufacture of the S&A device 200, secondary explosives are at all times physically separated from and out of line with sensitive primary explosives. During manufacture of the fuze 100, explosive elements are present only in the S&A device 200. Fuze assembly procedures may specify that the S&A device 200 be added only after all other operations are accomplished. During manufacture of the fuze 100, no high-speed airflow is available to activate the MAPG 97 with the result that there is no electrical power to the fuze circuit board 350. With no electrical energy in the fuze 100, the fuze circuit board 350 cannot send a command to enable mechanical arming of the S&A device 200. The S&A device 200 cannot arm itself without the proper sequence and duration of reversing accelerations or if the command arm signal is given at the wrong time.

The prior art munition warhead, fuze housing, stabilizer ribbon, and fuze slider have been produced for years so fabrication and assembly of these items is well documented and optimized for high volume output. These known components may be used in the fuze 100 by substituting an unthreaded ribbon pin for the prior art threaded ribbon pin. Preferably, the working parts and frame of the S&A device 200 are fabricated using a MEMS type high aspect ratio technology such as LIGA (lithography, plating, electroforming) in its direct (X-ray or Ultraviolet exposure lithography) or indirect (LIGA-derived tools used to print molds for micro die casting, metal injection molding, etc.) forms to create high-precision metal micro-scale parts inexpensively in a batch production process. The MEMS S&A device 200 may also be fabricated or assembled using similar scale technologies such as micro-molding, plating, plastic injection, metal and ceramic nano-powder casting or sintering, etc. Such parts typically have millimeter dimensions, but also have functional features in the micron range, for example the setback slider 5 is several millimeters long, but its integral spring 7 is comprised of 20-to 60-microns thick "coils."

Another example of functional features in the micron range is the command rotor 6 with overall size of about 2 mm, but small features, such as the latch barb 43 in the 10- to 50-micron range. A fabrication material such as metal is specified where ductility and toughness is needed. The material selection may include plated nickel, sintered metal, die-cast metal, and in some cases plastic. The S&A mechanism frame 1 may be fabricated in metal, plastic, or conceivably ceramic or a ceramic-metal mix. The current technology to produce the moving parts of the S&A device 200 involves lithographic imaging, developing, molding, and plating, often collectively referred to as LIGA technology.

The MAPG 97 is preferably fashioned out of plastic or a non-magnetic metal. The stator and coil set 300 are preferably made of the typical permeable core and insulated copper winding. The fuze housing 150 is preferably metal, the fuze slider 250 is preferably plastic or ceramic, the fuze circuit board 350 is preferably of rigid multi-layer construction, the S&A cover assembly 50 is preferably of rigid circuit board material, and the explosive output assembly 54 is preferably of metal, ceramic or plastic. However, other materials and fabrication technologies may be used to construct the diverse parts of the fuze 100 with no loss of function.

The means of clamping or fastening the S&A device 200 together are preferably threaded attachments 55, which may thread into threaded holes in the S&A base plate 15, but other well-known and adequate means may be used, such as rivets or threading a "baling wire" through the assembly bolt holes, with no loss of function.

In one preferred method of fabrication and assembly, the S&A device 200 is approximately 10 by 10 by 5 millimeters in size, the S&A mechanism frame 1 is 350 to 500 microns high above the substrate 2, and the working micro-scale mechanism parts 3, 4, 5, and 6, 7 and 9 are slightly thinner, to provide a working clearance. The fuze housing 150 is sized to fit on a typical DPICM grenade warhead. The fuze slider 250 incorporates the S&A device 200 and slides into and out of the fuze housing 150.

A lower overall cost for the S&A device 200 may be realized by fabricating high-precision parts, such as sliders and springs, or attachable springs separately, in a direct micromachining process such as UV-LIGA, and fabricating the parts that demand somewhat less precision, such as slider bodies and frames, in a less expensive embossing or injection-molding and then plating process. The UV-LIGA process uses low cost masks, a low cost portable UV light source, and low cost polymer starting material to expose and develop low cost molds which can then be electro-plated to yield somewhat less precise but much lower cost micro parts and frames.

The fuze circuitry may be implemented in numerous different ways to achieve the same functional end. In a given munition application it may be prudent to add other functions to the circuit, such as electronic time-outs for sensors or functions, or time-gating certain functions, or for implementing different algorithms to analyze and compare the derived flight characteristics, that is, the MAPG signal 86, to arrive at a command-arm decision. Also the decision circuitry and power management or fire circuit can be implemented using different circuit layouts, strategies, technologies, etc., without impairing the uniqueness of the inventive fuze embodiments.

While the invention has been described with reference to certain preferred embodiments, numerous changes, alterations and modifications to the described embodiments are possible without departing from the spirit and scope of the invention as defined in the appended claims, and equivalents thereof.

What is claimed is:

1. A MEMS safety and arming mechanism, comprising:

a setback slider operable to move in a first direction from a safe position to a latched position in response to a setback acceleration, the setback slider being spring biased against movement in the first direction;

an arming slider operable to move in a second direction opposite the first direction, from a safe position to an armed position in response to a deceleration, the arming slider being spring biased against movement in the second direction;

a first lock that prevents movement of the arming slider, the first lock comprising a setback sequence pivot that is rotatable from a first position that prevents movement of the arming slider to a second position that allows movement of the arming slider, the second position of the setback sequence pivot being attained when the setback slider reaches the latched position and the arming slider begins movement in the second direction; and a second lock that prevents movement of the arming slider, the second lock comprising a command rotor that is rotatable from a first position that prevents movement of the arming slider to a second position that allows movement of the arming slider, the second position of the command rotor being attained in response to a command arm electrical signal that is generated externally of the MEMS safety and arming mechanism.

2. The MEMS safety and arming mechanism of claim 1 further comprising a substrate and a frame above the substrate, the frame including openings in which each of the setback slider, arming slider, first lock and second lock move.

3. The MEMS safety and arming mechanism of claim 2 wherein the setback slider and the opening for the setback slider include zigzag portions that provide an inertial delay to movement of the setback slider.

4. The MEMS safety and arming mechanism of claim 2 wherein the command rotor first position is attained after partial movement of the arming slider in the second direction.

5. The MEMS safety and arming mechanism of claim 4 wherein the arming slider includes a transfer charge disposed therein.

6. The MEMS safety and arming mechanism of claim 5 further comprising a command rotor actuator disposed adjacent the command rotor and operable to move the command rotor from the first position to the second position in response to the command arm electrical signal.

7. The MEMS safety and arming mechanism of claim 6 wherein the command rotor actuator comprises a bellows actuator.

8. The MEMS safety and arming mechanism of claim 1 wherein the setback sequence pivot comprises right and left arms, the right arm being heavier than the left arm.

9. The MEMS safety and arming mechanism of claim 8 wherein the setback slider comprises a setback slider sequence pocket for receiving the left arm of the setback sequence pivot when the setback sequence pivot is in its second position.

10. The MEMS safety and arming mechanism of claim 8 wherein the arming slider includes a shoulder, the right arm of the setback sequence pivot bearing on the shoulder of the arming slider when the setback sequence pivot is in its first position.

11. The MEMS safety and arming mechanism of claim 2 wherein the command rotor includes a foot and the arming slider includes a safety catch tab, the foot of the command rotor engaging the safety catch tab of the arming slider when the command rotor is in its first position.

12. The MEMS safety and arming mechanism of claim 11 wherein the command rotor includes a latch barb and the frame includes a rotor latch indent, the latch barb engaging the rotor latch indent in the second position of the command rotor.

13. A MEMS safety and arming device, comprising:

the MEMS safety and arming mechanism of claim 5;

an input explosive column located adjacent one end of the transfer charge when the arming slider is in the armed position such that detonation of the input explosive column causes detonation of the transfer charge and located distant the one end of the transfer charge when the arming slider is in the safe position such that detonation of the input explosive column does not cause detonation of the transfer charge; and an output explosive column located adjacent another end of the transfer charge when the arming slider is in the armed position such that detonation of the transfer charge causes detonation of the output explosive column and located distant the another end of the transfer charge when the arming slider is in the safe position such that detonation of the transfer charge does not cause detonation of the output explosive column.

14. The MEMS safety and arming device of claim 13 further comprising a cover assembly with an explosive initiator, the cover assembly being disposed over the frame, the input explosive column being disposed in the cover assembly with one end of the input explosive column adjacent the initiator such that detonation of the initiator causes detonation of the input explosive column.

15. The MEMS safety and arming device of claim 14 further comprising an explosive output assembly with an explosive output charge, the explosive output assembly being disposed below the frame, the output explosive column being disposed in the explosive output assembly with one end of the output explosive column adjacent the explosive output charge such that detonation of the output explosive column causes detonation of the explosive output charge.

16. A fuze for a munition having a warhead, comprising:

a fuze housing;

a fuze slider having a first position in the fuze housing and a second position at least partially out of the fuze housing; and the safety and arming device of claim 15 disposed in the fuze housing.

17. The fuze of claim 16 wherein the safety and arming device is attached to the fuze slider and further wherein, in the first position of the fuze slider, the explosive output charge of the safety and arming device is located such that detonation of the explosive output charge does not cause detonation of the warhead and, in the second position of the fuze slider, the explosive output charge of the safety and arming device is located such that detonation of the explosive output charge does cause detonation of the warhead.

18. The fuze of claim 17 further comprising a fuze circuit board electrically connected to the safety and arming device; an accelerometer electrically connected to the fuze circuit board; and an air powered generator disposed on the fuze slider and electrically connected to the fuze circuit board.

19. The fuze of claim 18 further comprising a ribbon attached to the fuze housing wherein drag force on the ribbon is operable to free the fuze slider to move at least partially out of the fuze housing.

20. The fuze of claim 19 wherein, in the second position of the fuze slider, the air-powered generator supplies electric power and a signal indicative of fuze deceleration to the fuze circuit board as the fuze decelerates in the atmosphere.

21. The fuze of claim 20 wherein the fuze circuit board sends the command arm electrical signal to the MEMS safety and arming device when the command rotor is in its first position.

22. The fuze of claim 21 wherein the command arm electrical signal activates the command rotor actuator to move the command rotor from its first position to its second position.

23. The fuze of claim 22 wherein with the command rotor in its second position, the arming slider moves to the armed position, if the fuze has a deceleration greater than a spring force biasing the arming slider against movement to the armed position.

24. The fuze of claim 23 wherein when the accelerometer senses an impact, the fuze circuit board sends a fire signal to the explosive initiator in the cover assembly of the MEMS safety and arming device.

25. The fuze of claim 24 wherein the explosive initiator causes detonation of the input explosive column, which then detonates the transfer charge, if the arming slider is in the armed position.

26. The fuze of claim 25 wherein the transfer charge detonates the output explosive column, which detonates the explosive output charge, which detonates the warhead, if the fuze slider is in its second position.

* * * * *